US008851988B2

(12) United States Patent
Crowder

(10) Patent No.: US 8,851,988 B2
(45) **Date of Patent: *Oct. 7, 2014**

(54) APPARATUS, METHOD, AND SYSTEM TO PROVIDE A MULTIPLE PROCESSOR ARCHITECTURE FOR SERVER-BASED GAMING

(75) Inventor: Robert W. Crowder, Las Vegas, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 34 days.

This patent is subject to a terminal disclaimer.

(21) Appl. No.: 13/586,669

(22) Filed: Aug. 15, 2012

(65) Prior Publication Data

US 2013/0040732 A1 Feb. 14, 2013

Related U.S. Application Data

(63) Continuation of application No. 12/271,736, filed on Nov. 14, 2008, now Pat. No. 8,266,213.

(51) Int. Cl.
*G07F 17/32* (2006.01)

(52) U.S. Cl.
CPC ..... *G07F 17/32* (2013.01); *G07F 17/323* (2013.01); *G07F 17/3223* (2013.01); *G07F 17/3202* (2013.01)
USPC ..... 463/31

(58) Field of Classification Search
CPC ..... G07F 17/3202; G07F 17/3204; G07F 17/3211; G07F 17/3223; G07F 17/323
USPC ..... 463/31
See application file for complete search history.

(56) References Cited

U.S. PATENT DOCUMENTS

| | | | |
|---|---|---|---|
| 3,966,047 | A | 6/1976 | Steiner |
| 4,244,582 | A | 1/1981 | Raees et al. |
| 4,283,708 | A | 8/1981 | Lee |
| 4,339,798 | A | 7/1982 | Hedges et al. |
| 4,373,726 | A | 2/1983 | Churchill et al. |

(Continued)

FOREIGN PATENT DOCUMENTS

| | | | |
|---|---|---|---|
| CA | 1206173 | A1 | 6/1986 |
| DE | 19940954 | A1 | 3/2001 |

(Continued)

OTHER PUBLICATIONS

"BOB and LDAP," Gaming Standards Association, Fremont, California, 7 pages, Oct. 26, 2003.

(Continued)

*Primary Examiner* — Corbett B Coburn
(74) *Attorney, Agent, or Firm* — Frank Abramonte; Fearon Brown; Marvin Hein

(57) ABSTRACT

An architecture for an electronic gaming machine (EGM) includes multiple processors that separate game logic from game presentation. The multi-processor architecture includes a dedicated game logic engine and a dedicated presentation engine. A first processor having the game logic engine is adapted to handle the input/output (I/O), peripherals, communications, accounting, critical gaming and other game logic, power hit tolerances, protocols to other systems, and other tasks related to operation of the EGM. A second processor is adapted to running a presentation engine. The second processor receives commands from the first processor to present game-oriented outcome and results.

25 Claims, 5 Drawing Sheets

(56) References Cited

U.S. PATENT DOCUMENTS 4,448,419 A 5/1984 Telnaes
4,470,496 A 9/1984 Steiner
4,475,564 A 10/1984 Koester et al.
4,482,058 A 11/1984 Steiner
4,503,963 A 3/1985 Steiner
4,518,001 A 5/1985 Branham
4,574,824 A 3/1986 Paulsen et al.
4,588,292 A 5/1986 Collins
4,592,377 A 6/1986 Paulsen et al.
4,650,057 A 3/1987 Koester
4,721,307 A 1/1988 Okada
4,725,079 A 2/1988 Koza et al.
4,802,218 A 1/1989 Wright et al.
4,832,341 A 5/1989 Muller et al.
4,837,728 A 6/1989 Barrie et al.
4,861,041 A 8/1989 Jones et al.
4,885,700 A 12/1989 Kondziolka et al.
4,926,996 A 5/1990 Eglise et al.
4,948,138 A 8/1990 Pease et al.
4,973,851 A 11/1990 Lee
4,978,322 A 12/1990 Paulsen
4,995,615 A 2/1991 Cheng
5,007,649 A 4/1991 Richardson
5,083,800 A 1/1992 Lockton
5,100,137 A 3/1992 Fulton
5,167,411 A 12/1992 Isobe
5,167,413 A 12/1992 Fulton
5,167,571 A 12/1992 Waller
5,179,517 A 1/1993 Sarbin et al.
5,199,710 A 4/1993 Lamle
5,242,041 A 9/1993 Isobe
5,242,163 A 9/1993 Fulton
5,248,142 A 9/1993 Breeding
5,251,897 A 10/1993 Fulton
5,258,837 A 11/1993 Gormley
5,265,874 A 11/1993 Dickinson et al.
5,275,400 A 1/1994 Weingardt et al.
5,321,241 A 6/1994 Craine
5,324,035 A 6/1994 Morris et al.
5,326,104 A 7/1994 Pease et al.
5,332,219 A 7/1994 Marnell, II et al.
5,344,144 A 9/1994 Canon
5,364,104 A 11/1994 Jones et al.
5,381,019 A 1/1995 Sato
5,386,103 A 1/1995 DeBan et al.
5,393,067 A 2/1995 Paulsen et al.
5,397,125 A 3/1995 Adams
5,398,932 A 3/1995 Eberhardt et al.
5,411,257 A 5/1995 Fulton
5,417,430 A 5/1995 Breeding
5,420,406 A 5/1995 Izawa et al.
5,431,408 A 7/1995 Adams
5,435,778 A 7/1995 Castle et al.
5,437,451 A 8/1995 Fulton
5,472,194 A 12/1995 Breeding et al.
5,487,544 A 1/1996 Clapper, Jr.
5,493,613 A 2/1996 Denno et al.
5,494,144 A 2/1996 Izawa
5,505,449 A 4/1996 Eberhardt et al.
5,505,461 A 4/1996 Bell et al.
5,507,489 A 4/1996 Reibel et al.
5,531,640 A 7/1996 Inoue
5,544,892 A 8/1996 Breeding
5,544,893 A 8/1996 Jones et al.
5,562,284 A 10/1996 Stevens
5,570,885 A 11/1996 Ornstein
5,580,311 A 12/1996 Haste, III
5,605,334 A 2/1997 McCrea, Jr.
5,605,506 A 2/1997 Hoorn et al.
5,613,680 A 3/1997 Groves et al.
5,613,912 A 3/1997 Slater
5,615,280 A 3/1997 Izawa et al.
5,636,842 A 6/1997 Cabot et al.
5,636,843 A 6/1997 Roberts
5,643,086 A 7/1997 Alcorn et al.
5,645,486 A 7/1997 Nagao et al.
5,653,635 A 8/1997 Breeding
5,655,961 A 8/1997 Acres et al.
5,676,231 A 10/1997 Legras et al.
5,685,774 A 11/1997 Webb
5,707,287 A 1/1998 McCrea, Jr.
5,711,525 A 1/1998 Breeding
5,735,525 A 4/1998 McCrea, Jr.
5,737,418 A 4/1998 Saffari et al.
5,741,183 A 4/1998 Acres et al.
5,745,110 A 4/1998 Ertemalp
5,759,102 A 6/1998 Pease et al.
5,766,076 A 6/1998 Pease et al.
5,769,458 A 6/1998 Carides et al.
5,770,533 A 6/1998 Franchi
5,779,545 A 7/1998 Berg et al.
5,788,574 A 8/1998 Ornstein et al.
5,794,964 A 8/1998 Jones et al.
5,795,225 A 8/1998 Jones et al.
5,800,268 A 9/1998 Molnick
5,803,809 A 9/1998 Yoseloff
5,813,912 A 9/1998 Shultz
5,816,918 A 10/1998 Kelly et al.
5,823,534 A 10/1998 Banyai
5,823,879 A 10/1998 Goldberg et al.
5,830,067 A 11/1998 Graves et al.
5,830,068 A 11/1998 Brenner et al.
5,836,586 A 11/1998 Marks et al.
5,839,730 A 11/1998 Pike
5,842,921 A 12/1998 Mindes et al.
5,850,447 A 12/1998 Peyret
5,851,011 A 12/1998 Lott
5,851,148 A 12/1998 Brune et al.
5,851,149 A 12/1998 Xidos et al.
5,855,515 A 1/1999 Pease et al.
5,867,586 A 2/1999 Liang
5,885,158 A 3/1999 Torango et al.
5,890,963 A 4/1999 Yen
5,895,451 A 4/1999 Yamade et al.
5,905,847 A 5/1999 Kobayashi et al.
5,910,044 A 6/1999 Luciano, Jr. et al.
5,911,418 A 6/1999 Adams
5,911,419 A 6/1999 Delaney et al.
5,911,626 A 6/1999 McCrea, Jr.
5,919,091 A 7/1999 Bell et al.
5,931,731 A 8/1999 Chwalisz
5,934,999 A 8/1999 Valdez
5,941,771 A 8/1999 Haste, III
5,957,776 A 9/1999 Hoehne
5,971,851 A 10/1999 Pascal et al.
5,974,135 A 10/1999 Breneman et al.
5,999,808 A 12/1999 LaDue
6,001,016 A 12/1999 Walker et al.
6,003,651 A 12/1999 Waller et al.
6,004,205 A 12/1999 Lauretta et al.
6,019,210 A 2/2000 Matsunaga et al.
6,019,374 A 2/2000 Breeding
6,032,955 A 3/2000 Luciano et al.
6,042,150 A 3/2000 Daley
6,045,130 A 4/2000 Jones et al.
6,047,322 A 4/2000 Vaid et al.
6,048,269 A 4/2000 Burns et al.
6,056,641 A 5/2000 Webb
6,059,289 A 5/2000 Vancura
6,062,981 A 5/2000 Luciano, Jr.
6,066,439 A 5/2000 Nohr et al.
6,068,553 A 5/2000 Parker
6,070,878 A 6/2000 Jones et al.
6,077,161 A 6/2000 Wisler
6,080,063 A 6/2000 Khosla
6,083,105 A 7/2000 Ronin et al.
6,089,978 A 7/2000 Adams
6,089,980 A 7/2000 Gauselmann
6,093,103 A 7/2000 McCrea, Jr.
6,098,837 A 8/2000 Izawa et al.
6,099,407 A 8/2000 Parker, Jr. et al.
6,102,799 A 8/2000 Stupak
6,104,815 A 8/2000 Alcorn et al.
6,105,747 A 8/2000 Uemizo et al.

(56) References Cited

U.S. PATENT DOCUMENTS 6,106,396 A 8/2000 Alcorn et al.
6,110,041 A 8/2000 Walker et al.
6,110,043 A 8/2000 Olsen
6,117,012 A 9/2000 McCrea, Jr.
6,120,377 A 9/2000 McGinnis, Sr. et al.
6,120,588 A 9/2000 Jacobson
6,123,333 A 9/2000 McGinnis, Sr. et al.
6,125,195 A 9/2000 Ohya et al.
6,126,542 A 10/2000 Fier
6,135,887 A 10/2000 Pease et al.
6,146,273 A 11/2000 Olsen
6,149,522 A 11/2000 Alcorn et al.
6,152,822 A 11/2000 Herbert
6,152,824 A 11/2000 Rothschild et al.
6,165,069 A 12/2000 Sines et al.
6,166,763 A 12/2000 Rhodes et al.
6,168,513 B1 1/2001 Souza et al.
6,168,523 B1 1/2001 Piechowiak et al.
6,179,110 B1 1/2001 Ohkawa et al.
6,179,711 B1 1/2001 Yoseloff
6,183,366 B1 2/2001 Goldberg et al.
6,185,184 B1 2/2001 Mattaway et al.
6,186,892 B1 2/2001 Frank et al.
6,186,894 B1 2/2001 Mayeroff
6,186,895 B1 2/2001 Oliver
6,190,256 B1 2/2001 Walker et al.
6,203,430 B1 3/2001 Walker et al.
6,210,275 B1 4/2001 Olsen
6,210,277 B1 4/2001 Stefan
6,213,877 B1 4/2001 Walker et al.
6,217,447 B1 4/2001 Lofink et al.
6,219,836 B1 4/2001 Wells et al.
6,220,954 B1 4/2001 Nguyen et al.
6,224,483 B1 5/2001 Mayeroff
6,224,484 B1 5/2001 Okuda et al.
6,227,969 B1 5/2001 Yoseloff
6,227,972 B1 5/2001 Walker et al.
6,234,898 B1 5/2001 Belamant et al.
6,244,958 B1 6/2001 Acres
6,251,014 B1 6/2001 Stockdale et al.
6,254,483 B1 7/2001 Acres
6,254,484 B1 7/2001 McCrea, Jr.
6,256,651 B1 7/2001 Tuli
6,264,109 B1 7/2001 Chapet et al.
6,264,561 B1 7/2001 Saffari et al.
6,273,424 B1 8/2001 Breeding
6,275,586 B1 8/2001 Kelly
6,283,856 B1 9/2001 Mothwurf
6,287,202 B1 9/2001 Pascal et al.
6,290,603 B1 9/2001 Luciano, Jr.
6,293,864 B1 9/2001 Romero
6,302,793 B1 10/2001 Fertitta, III et al.
6,309,300 B1 10/2001 Glavich
6,312,332 B1 11/2001 Walker et al.
6,312,334 B1 11/2001 Yoseloff
6,315,664 B1 11/2001 Baerlocher et al.
6,322,078 B1 11/2001 Adams
6,328,649 B1 12/2001 Randall et al.
6,334,614 B1 1/2002 Breeding
6,334,814 B1 1/2002 Adams
6,336,863 B1 1/2002 Baerlocher et al.
6,346,043 B1 2/2002 Colin et al.
6,346,044 B1 2/2002 McCrea, Jr.
6,347,738 B1 2/2002 Crevelt et al.
6,350,193 B1 2/2002 Paulsen
6,352,261 B1 3/2002 Brown
6,362,836 B1 3/2002 Shaw et al.
6,364,767 B1 4/2002 Brossard et al.
6,371,482 B1 4/2002 Hall, Jr.
6,375,187 B1 4/2002 Baerlocher
6,380,953 B1 4/2002 Mizuno
6,383,076 B1 5/2002 Tiedeken
6,389,126 B1 5/2002 Bjornberg et al.
6,394,900 B1 5/2002 McGlone et al.
6,394,902 B1 5/2002 Glavich et al.
6,394,907 B1 5/2002 Rowe
6,400,272 B1 6/2002 Holtzman et al.
6,401,099 B1 6/2002 Koppolu et al.
6,406,023 B1 6/2002 Rowe
6,406,369 B1 6/2002 Baerlocher et al.
6,409,602 B1 6/2002 Wiltshire et al.
6,413,161 B1 7/2002 Baerlocher et al.
6,413,162 B1 7/2002 Baerlocher et al.
6,416,408 B2 7/2002 Tracy et al.
6,419,583 B1 7/2002 Crumby et al.
6,425,824 B1 7/2002 Baerlocher et al.
6,439,995 B1 8/2002 Hughs-Baird et al.
6,439,996 B2 8/2002 LeMay et al.
6,443,452 B1 9/2002 Brune
6,443,839 B2 9/2002 Stockdale et al.
6,454,266 B1 9/2002 Breeding et al.
6,459,882 B1 10/2002 Palermo et al.
6,460,848 B1 10/2002 Soltys et al.
6,461,241 B1 10/2002 Webb et al.
6,464,582 B1 10/2002 Baerlocher et al.
6,464,584 B2 10/2002 Oliver
6,468,156 B1 10/2002 Hughs-Baird et al.
6,471,208 B2 10/2002 Yoseloff et al.
6,471,591 B1 10/2002 Crumby
6,488,581 B1 12/2002 Stockdale
6,488,585 B1 12/2002 Wells et al.
6,490,285 B2 12/2002 Lee et al.
6,494,454 B2 12/2002 Adams
6,494,785 B1 12/2002 Gerrard et al.
6,497,408 B1 12/2002 Walker et al.
6,503,147 B1 1/2003 Stockdale et al.
6,505,772 B1 1/2003 Mollett et al.
6,506,118 B1 1/2003 Baerlocher et al.
6,508,709 B1 1/2003 Karmarkar
6,508,710 B1 1/2003 Paravia et al.
6,511,375 B1 1/2003 Kaminkow
6,514,141 B1 2/2003 Kaminkow et al.
6,516,350 B1 2/2003 Lumelsky et al.
6,517,435 B2 2/2003 Soltys et al.
6,517,436 B2 2/2003 Soltys et al.
6,520,857 B2 2/2003 Soltys et al.
6,527,271 B2 3/2003 Soltys et al.
6,527,638 B1 3/2003 Walker et al.
6,530,836 B2 3/2003 Soltys et al.
6,530,837 B2 3/2003 Soltys et al.
6,533,276 B2 3/2003 Soltys et al.
6,533,662 B2 3/2003 Soltys et al.
6,547,131 B1 4/2003 Foodman et al.
6,561,900 B1 5/2003 Baerlocher et al.
6,565,433 B1 5/2003 Baerlocher et al.
6,565,436 B1 5/2003 Baerlocher
6,569,015 B1 5/2003 Baerlocher et al.
6,572,472 B1 6/2003 Glavich
6,572,473 B1 6/2003 Baerlocher
6,575,829 B2 6/2003 Coleman et al.
6,575,833 B1 6/2003 Stockdale
6,575,834 B1 6/2003 Lindo
6,578,847 B1 6/2003 Hedrick et al.
6,579,179 B2 6/2003 Poole et al.
6,579,180 B2 6/2003 Soltys et al.
6,579,181 B2 6/2003 Soltys et al.
6,581,747 B1 6/2003 Charlier et al.
6,582,306 B1 6/2003 Kaminkow
6,582,307 B2 6/2003 Webb
6,585,588 B2 7/2003 Hartl
6,585,591 B1 7/2003 Baerlocher et al.
6,585,592 B1 7/2003 Crumby
6,585,598 B2 7/2003 Nguyen et al.
6,592,458 B1 7/2003 Ho
6,595,854 B2 7/2003 Hughs-Baird et al.
6,595,857 B2 7/2003 Soltys et al.
6,599,185 B1 7/2003 Kaminkow et al.
6,599,192 B1 7/2003 Baerlocher et al.
6,599,193 B2 7/2003 Baerlocher et al.
6,602,135 B1 8/2003 Gerrard
6,602,136 B1 8/2003 Baerlocher et al.
6,602,137 B2 8/2003 Kaminkow et al.
6,605,000 B2 8/2003 Adams
6,607,438 B2 8/2003 Baerlocher et al.

(56) References Cited

U.S. PATENT DOCUMENTS 6,607,441 B1 8/2003 Acres
6,609,974 B2 8/2003 Mead et al.
6,609,978 B1 8/2003 Paulsen
6,612,928 B1 9/2003 Bradford et al.
6,620,046 B2 9/2003 Rowe
6,620,047 B1 9/2003 Alcorn et al.
6,629,184 B1 9/2003 Berg et al.
6,629,591 B1 10/2003 Griswold et al.
6,632,139 B1 10/2003 Baerlocher
6,634,943 B1 10/2003 Baerlocher
6,634,945 B2 10/2003 Glavich et al.
6,638,161 B2 10/2003 Soltys et al.
6,638,164 B2 10/2003 Randall et al.
6,638,170 B1 10/2003 Crumby
6,641,484 B2 11/2003 Oles et al.
6,645,073 B2 11/2003 Lemay et al.
6,645,077 B2 11/2003 Rowe
6,648,753 B1 11/2003 Tracy et al.
6,648,754 B2 11/2003 Baerlocher et al.
6,651,985 B2 11/2003 Sines et al.
6,652,378 B2 11/2003 Cannon et al.
6,656,048 B2 12/2003 Olsen
6,659,461 B2 12/2003 Yoseloff et al.
6,659,864 B2 12/2003 McGahn et al.
6,663,488 B1 12/2003 Adams
6,663,489 B2 12/2003 Baerlocher
6,663,490 B2 12/2003 Soltys et al.
6,669,559 B1 12/2003 Baerlocher et al.
6,675,152 B1 1/2004 Prasad et al.
6,676,522 B2 1/2004 Rowe et al.
6,682,421 B1 1/2004 Rowe et al.
6,682,423 B2 1/2004 Brosnan et al.
6,685,564 B2 2/2004 Oliver
6,685,567 B2 2/2004 Cockerille et al.
6,688,975 B2 2/2004 Baerlocher et al.
6,688,977 B1 2/2004 Baerlocher et al.
6,688,979 B2 2/2004 Soltys et al.
6,692,354 B2 2/2004 Tracy et al.
6,692,355 B2 2/2004 Baerlocher et al.
6,699,128 B1 3/2004 Beadell et al.
6,702,291 B2 3/2004 Grebler et al.
6,709,324 B1 3/2004 Beadell
6,712,695 B2 3/2004 Mothwurf et al.
6,712,696 B2 3/2004 Soltys et al.
6,718,361 B1 4/2004 Basani et al.
6,719,632 B2 4/2004 Palmer et al.
6,722,974 B2 4/2004 Sines et al.
6,722,981 B2 4/2004 Kaminkow et al.
6,722,982 B2 4/2004 Kaminkow et al.
6,722,983 B2 4/2004 Kaminkow et al.
6,722,985 B2 4/2004 Criss-Puszkiewicz et al.
6,726,563 B1 4/2004 Baerlocher et al.
6,726,565 B2 4/2004 Hughs-Baird
6,728,740 B2 4/2004 Kelly et al.
6,733,386 B2 5/2004 Cuddy et al.
6,733,389 B2 5/2004 Webb et al.
6,736,250 B2 5/2004 Mattice
6,739,975 B2 5/2004 Nguyen et al.
6,743,102 B1 6/2004 Fiechter et al.
6,745,330 B1 6/2004 Maillot
6,746,330 B2 6/2004 Cannon
6,749,504 B2 6/2004 Hughs-Baird
6,749,515 B2 6/2004 Hedrick et al.
6,752,312 B1 6/2004 Chamberlain et al.
6,755,741 B1 6/2004 Rafaeli
6,758,747 B2 7/2004 Baerlocher
6,758,750 B2 7/2004 Baerlocher et al.
6,758,751 B2 7/2004 Soltys et al.
6,769,983 B2 8/2004 Slomiany
6,789,801 B2 9/2004 Snow
6,800,029 B2 10/2004 Rowe et al.
6,808,173 B2 10/2004 Snow
6,811,488 B2 11/2004 Paravia et al.
6,817,948 B2 11/2004 Pascal et al.
6,823,419 B2 11/2004 Berg et al.
6,837,789 B2 1/2005 Garahi et al.
6,846,238 B2 1/2005 Wells
6,848,994 B1 2/2005 Knust et al.
6,866,581 B2 3/2005 Martinek et al.
6,866,586 B2 3/2005 Oberberger et al.
6,874,681 B1 4/2005 Izawa et al.
6,874,786 B2 4/2005 Bruno et al.
6,884,170 B2 4/2005 Rowe
6,884,173 B2 4/2005 Gauselmann
6,884,174 B2 4/2005 Lundy et al.
6,896,618 B2 5/2005 Benoy et al.
6,899,627 B2 5/2005 Lam et al.
6,905,411 B2 6/2005 Nguyen et al.
6,908,387 B2 6/2005 Hedrick et al.
6,923,446 B2 8/2005 Snow
6,938,900 B2 9/2005 Snow
6,955,599 B2 10/2005 Bourbour et al.
6,960,134 B2 11/2005 Hartl et al.
6,962,530 B2 11/2005 Jackson
6,971,956 B2 12/2005 Rowe et al.
6,972,682 B2 12/2005 Lareau et al.
6,986,514 B2 1/2006 Snow
6,991,540 B2 1/2006 Marlow
6,991,544 B2 1/2006 Soltys et al.
6,993,587 B1 1/2006 Basani et al.
6,997,803 B2 2/2006 LeMay et al.
7,000,921 B2 2/2006 Schultz
7,013,469 B2 3/2006 Smith et al.
7,025,674 B2 4/2006 Adams et al.
7,027,996 B2 4/2006 Levinson
7,035,626 B1 4/2006 Luciano, Jr.
7,037,195 B2 5/2006 Schneider et al.
7,050,056 B2 5/2006 Meyringer
7,062,470 B2 6/2006 Prasad et al.
7,063,617 B2 6/2006 Brosnan et al.
7,077,332 B2 7/2006 Verschuur et al.
7,086,947 B2 8/2006 Walker et al.
7,099,035 B2 8/2006 Brooks et al.
7,100,184 B1 8/2006 Kahn
7,112,138 B2 9/2006 Hedrick et al.
7,114,718 B2 10/2006 Grauzer et al.
7,116,782 B2 10/2006 Jackson et al.
7,120,879 B2 10/2006 Gutberlet et al.
7,147,558 B2 12/2006 Giobbi
7,168,089 B2 1/2007 Nguyen et al.
7,179,170 B2 2/2007 Martinek et al.
7,186,181 B2 3/2007 Rowe
7,197,765 B2 3/2007 Chan et al.
7,198,571 B2 4/2007 LeMay et al.
RE39,644 E 5/2007 Alcorn et al.
7,260,834 B1 8/2007 Carlson
7,291,068 B2 11/2007 Bryant et al.
7,293,282 B2 11/2007 Danforth et al.
7,300,352 B2 11/2007 Rowe
7,303,475 B2 12/2007 Britt et al.
7,309,065 B2 12/2007 Yoseloff et al.
7,311,605 B2 12/2007 Moser
7,329,185 B2 2/2008 Conover et al.
7,330,822 B1 2/2008 Robson et al.
7,331,520 B2 2/2008 Silva et al.
7,331,579 B2 2/2008 Snow
7,337,330 B2 2/2008 Gatto et al.
7,346,682 B2 3/2008 Basani et al.
7,349,920 B1 3/2008 Feinberg et al.
7,351,147 B2 4/2008 Stockdale et al.
7,353,183 B1 4/2008 Musso
7,356,770 B1 4/2008 Jackson
7,363,342 B1 4/2008 Wang et al.
7,364,510 B2 4/2008 Walker et al.
7,370,282 B2 5/2008 Cary
7,384,339 B2 6/2008 LeMay et al.
7,390,256 B2 6/2008 Soltys et al.
7,398,327 B2 7/2008 Lee
7,410,422 B2 8/2008 Fine
7,419,428 B2 9/2008 Rowe
7,427,233 B2 9/2008 Walker et al.
7,427,234 B2 9/2008 Soltys et al.
7,427,236 B2 9/2008 Kaminkow et al.
7,434,805 B2 10/2008 Grauzer et al.

(56) References Cited

U.S. PATENT DOCUMENTS 7,435,179 B1 10/2008 Ford
7,438,221 B2 10/2008 Washington et al.
7,438,643 B2 10/2008 Brosnan et al.
7,448,626 B2 11/2008 Fleckenstein
7,455,591 B2 11/2008 Nguyen
7,460,863 B2 12/2008 Steelberg et al.
7,465,231 B2 12/2008 Lewin et al.
7,473,178 B2 1/2009 Boyd et al.
7,483,394 B2 1/2009 Chang et al.
7,494,413 B2 2/2009 Singer et al.
7,500,915 B2 3/2009 Wolf et al.
7,510,186 B2 3/2009 Fleckenstein
7,510,194 B2 3/2009 Soltys et al.
7,510,474 B2 3/2009 Carter, Sr.
7,515,718 B2 4/2009 Nguyen et al.
7,534,169 B2 5/2009 Amaitis et al.
7,549,576 B2 6/2009 Alderucci et al.
7,559,080 B2 7/2009 Bhargavan et al.
7,566,274 B2 7/2009 Johnson et al.
7,575,234 B2 8/2009 Soltys et al.
7,577,847 B2 8/2009 Nguyen et al.
7,578,739 B2 8/2009 Gauselmann
7,581,256 B2 8/2009 Cockerille et al.
7,585,217 B2 9/2009 Lutnick et al.
7,594,030 B2 9/2009 Teodosiu et al.
7,607,976 B2 10/2009 Baerlocher et al.
7,607,977 B2 10/2009 Baerlocher et al.
7,610,549 B2 10/2009 Vignet
7,611,407 B1 11/2009 Itkis et al.
7,611,409 B2 11/2009 Muir et al.
7,617,151 B2 11/2009 Rowe
7,618,317 B2 11/2009 Jackson
7,621,809 B2 11/2009 Baerlocher et al.
7,629,886 B2 12/2009 Steeves
7,634,550 B2 12/2009 Wolber et al.
7,637,810 B2 12/2009 Amaitis et al.
7,644,861 B2 1/2010 Alderucci et al.
7,648,414 B2 1/2010 McNutt et al.
7,666,081 B2 2/2010 Baerlocher et al.
7,674,179 B2 3/2010 Baerlocher et al.
7,682,249 B2 3/2010 Winans et al.
7,684,874 B2 3/2010 Schlottmann et al.
7,684,882 B2 3/2010 Baerlocher et al.
7,685,516 B2 3/2010 Fischer
7,685,593 B2 3/2010 Solomon et al.
7,686,688 B2 3/2010 Friedman et al.
7,688,322 B2 3/2010 Kapler et al.
7,689,302 B2 3/2010 Schlottmann et al.
7,690,995 B2 4/2010 Frankulin et al.
7,699,697 B2 4/2010 Darrah et al.
7,699,703 B2 4/2010 Muir et al.
7,702,719 B1 4/2010 Betz et al.
7,706,895 B2 4/2010 Callaghan
7,712,050 B2 5/2010 Gutberlet et al.
7,722,453 B2 5/2010 Lark et al.
7,730,198 B2 6/2010 Ruppert et al.
7,744,462 B2 6/2010 Grav et al.
7,747,741 B2 6/2010 Basani et al.
7,753,790 B2 7/2010 Nguyen et al.
7,769,877 B2 8/2010 McBride et al.
7,778,635 B2 8/2010 Crookham et al.
7,780,525 B2 8/2010 Walker et al.
7,780,526 B2 8/2010 Nguyen et al.
7,780,529 B2 8/2010 Rowe et al.
7,783,881 B2 8/2010 Morrow et al.
7,785,204 B2 8/2010 Wells et al.
7,787,972 B2 8/2010 Schlottmann et al.
7,788,503 B2 8/2010 Gatto et al.
7,824,267 B2 11/2010 Cannon et al.
7,828,649 B2 11/2010 Cuddy et al.
7,841,946 B2 11/2010 Walker et al.
7,844,944 B2 11/2010 Gutberlet et al.
7,846,020 B2 12/2010 Walker et al.
7,850,528 B2 12/2010 Wells
7,857,702 B2 12/2010 Hilbert
7,862,425 B2 1/2011 Cavagna
7,867,081 B2 1/2011 Schneider et al.
7,874,920 B2 1/2011 Hornik et al.
7,874,921 B2 1/2011 Baszucki et al.
7,892,093 B2 2/2011 Kniesteadt et al.
7,898,679 B2 3/2011 Brack et al.
7,901,294 B2 3/2011 Walker et al.
7,905,780 B2 3/2011 Morrow et al.
7,908,486 B2 3/2011 Gatto et al.
7,918,735 B2 4/2011 Inamura
7,921,026 B2 4/2011 O'Cull et al.
7,921,405 B2 4/2011 Gupta et al.
7,931,533 B2 4/2011 LeMay et al.
7,937,464 B2 5/2011 Ruppert et al.
7,963,847 B2 6/2011 Baerlocher
7,993,199 B2 8/2011 Iddings et al.
8,033,913 B2 10/2011 Cockerille et al.
8,037,313 B2 10/2011 Hämäläinen et al.
8,051,180 B2 11/2011 Mazzaferri et al.
8,057,297 B2 11/2011 Silvestro
8,070,583 B2 12/2011 Baerlocher et al.
8,070,597 B2 12/2011 Cuddy
8,073,657 B2 12/2011 Moore, III et al.
8,075,396 B2 12/2011 Roemer
8,117,461 B2 2/2012 Bigelow, Jr. et al.
8,177,634 B2 5/2012 Herrmann et al.
8,182,346 B2 5/2012 Herrmann et al.
8,185,423 B2 5/2012 Brook et al.
8,187,101 B2 5/2012 Herrmann et al.
8,192,289 B2 6/2012 Herrmann et al.
8,197,344 B2 6/2012 Rathsack et al.
8,201,229 B2 6/2012 Ruppert et al.
8,246,466 B2 8/2012 Herrmann et al.
8,267,773 B2 9/2012 Jaffe et al.
8,267,797 B2 9/2012 Thomas et al.
8,277,324 B2 10/2012 Herrmann et al.
8,280,777 B2 10/2012 Mengerink et al.
8,360,870 B2 1/2013 Herrmann et al.
8,366,550 B2 2/2013 Herrmann et al.
8,512,150 B2 8/2013 Herrmann et al.
2001/0019966 A1 9/2001 Idaka
2002/0004824 A1 1/2002 Cuan et al.
2002/0084587 A1 7/2002 Bennett et al.
2002/0086725 A1 7/2002 Fasbender et al.
2002/0111210 A1 8/2002 Luciano, Jr. et al.
2002/0111213 A1 8/2002 McEntee et al.
2002/0113371 A1 8/2002 Snow
2002/0115487 A1 8/2002 Wells
2002/0142844 A1 10/2002 Kerr
2002/0144115 A1 10/2002 Lemay et al.
2002/0147047 A1 10/2002 Letovsky et al.
2002/0151363 A1 10/2002 Letovsky et al.
2002/0152120 A1 10/2002 Howington
2002/0195773 A1 12/2002 Dunn
2003/0004871 A1 1/2003 Rowe
2003/0022714 A1 1/2003 Oliver
2003/0027625 A1 2/2003 Rowe
2003/0032474 A1 2/2003 Kaminkow
2003/0036425 A1 2/2003 Kaminkow et al.
2003/0042679 A1 3/2003 Snow
2003/0045354 A1 3/2003 Giobbi
2003/0064798 A1 4/2003 Grauzer et al.
2003/0075869 A1 4/2003 Breeding et al.
2003/0090064 A1 5/2003 Hoyt et al.
2003/0100369 A1 5/2003 Gatto et al.
2003/0104865 A1 6/2003 Itkis et al.
2003/0130024 A1 7/2003 Darby
2003/0182414 A1 9/2003 O'Neill
2003/0185229 A1 10/2003 Shachar et al.
2003/0186739 A1 10/2003 Paulsen et al.
2003/0203755 A1 10/2003 Jackson
2003/0206548 A1 11/2003 Bannai et al.
2003/0224858 A1 12/2003 Yoseloff et al.
2003/0228912 A1 12/2003 Wells et al.
2003/0232651 A1 12/2003 Huard et al.
2003/0236110 A1 12/2003 Beaulieu et al.
2004/0002386 A1 1/2004 Wolfe et al.
2004/0002388 A1 1/2004 Larsen et al.
2004/0029635 A1 2/2004 Giobbi

(56) References Cited

U.S. PATENT DOCUMENTS

2004/0043815 A1 3/2004 Kaminkow
2004/0043820 A1 3/2004 Schlottmann
2004/0048671 A1 3/2004 Rowe
2004/0064817 A1 4/2004 Shibayama et al.
2004/0082385 A1 4/2004 Silva et al.
2004/0087375 A1 5/2004 Gelinotte
2004/0090003 A1 5/2004 Snow
2004/0092310 A1 5/2004 Brosnan et al.
2004/0106452 A1 6/2004 Nguyen et al.
2004/0110119 A1 6/2004 Riconda et al.
2004/0127291 A1 7/2004 George et al.
2004/0132529 A1 7/2004 Mkrtchyan et al.
2004/0133485 A1 7/2004 Schoonmaker et al.
2004/0142744 A1 7/2004 Atkinson et al.
2004/0150702 A1 8/2004 Tsuyoshi et al.
2004/0166918 A1 8/2004 Walker et al.
2004/0166940 A1 8/2004 Rothschild
2004/0185936 A1 9/2004 Block et al.
2004/0229684 A1 11/2004 Blackburn et al.
2004/0254993 A1 12/2004 Mamas
2004/0259618 A1 12/2004 Soltys et al.
2005/0043094 A1 2/2005 Nguyen et al.
2005/0054438 A1 3/2005 Rothschild et al.
2005/0054445 A1 3/2005 Gatto et al.
2005/0055113 A1 3/2005 Gauselmann
2005/0059479 A1 3/2005 Soltys et al.
2005/0070358 A1 3/2005 Angell et al.
2005/0080898 A1 4/2005 Block
2005/0101383 A1 5/2005 Wells
2005/0116417 A1 6/2005 Soltys et al.
2005/0119052 A1 6/2005 Russell et al.
2005/0143166 A1 6/2005 Walker et al.
2005/0153778 A1 7/2005 Nelson et al.
2005/0171808 A1 8/2005 Saenz et al.
2005/0176502 A1 8/2005 Nishimura et al.
2005/0181856 A1 8/2005 Cannon et al.
2005/0181864 A1 8/2005 Britt et al.
2005/0215311 A1 9/2005 Hornik et al.
2005/0221882 A1 10/2005 Nguyen et al.
2005/0222891 A1 10/2005 Chan et al.
2005/0227760 A1 10/2005 Vlazny et al.
2005/0239542 A1 10/2005 Olsen
2005/0266919 A1 12/2005 Rowe et al.
2005/0282626 A1 12/2005 Manfredi et al.
2006/0003828 A1 1/2006 Abecassis
2006/0004618 A1 1/2006 Brixius
2006/0009282 A1 1/2006 George et al.
2006/0015716 A1 1/2006 Thornton et al.
2006/0019745 A1 1/2006 Benbrahim
2006/0026499 A1 2/2006 Weddle
2006/0035707 A1 2/2006 Nguyen et al.
2006/0046849 A1 3/2006 Kovacs
2006/0116208 A1 6/2006 Chen et al.
2006/0117314 A1 6/2006 Sato
2006/0121970 A1 6/2006 Khal
2006/0130046 A1 6/2006 O'Neill
2006/0183541 A1 8/2006 Okada et al.
2006/0195847 A1 8/2006 Amano et al.
2006/0205508 A1 9/2006 Green
2006/0211481 A1 9/2006 Soltys et al.
2006/0217202 A1 9/2006 Burke et al.
2006/0247013 A1 11/2006 Walker et al.
2006/0247057 A1 11/2006 Green et al.
2006/0248161 A1 11/2006 O'Brien et al.
2006/0252530 A1 11/2006 Oberberger et al.
2006/0253702 A1 11/2006 Lowell et al.
2006/0259604 A1 11/2006 Kotchavi et al.
2006/0277487 A1 12/2006 Poulsen et al.
2006/0287077 A1 12/2006 Grav et al.
2006/0287098 A1 12/2006 Morrow et al.
2007/0004500 A1 1/2007 Soltys et al.
2007/0004501 A1 1/2007 Brewer et al.
2007/0015583 A1 1/2007 Tran
2007/0026935 A1 2/2007 Wolf et al.
2007/0032288 A1 2/2007 Nelson et al.
2007/0033247 A1 2/2007 Martin
2007/0054725 A1 3/2007 Morrow et al.
2007/0054740 A1 3/2007 Salls et al.
2007/0057453 A1 3/2007 Soltys et al.
2007/0057454 A1 3/2007 Fleckenstein
2007/0057462 A1 3/2007 Fleckenstein
2007/0057466 A1 3/2007 Soltys et al.
2007/0057469 A1 3/2007 Grauzer et al.
2007/0060259 A1 3/2007 Pececnik
2007/0060260 A1 3/2007 Fleckenstein
2007/0060307 A1 3/2007 Mathis et al.
2007/0060320 A1 3/2007 Kelly et al.
2007/0060365 A1 3/2007 Tien et al.
2007/0067768 A1 3/2007 Breckner et al.
2007/0077990 A1 4/2007 Cuddy et al.
2007/0077995 A1 4/2007 Oak et al.
2007/0093298 A1 4/2007 Brunet
2007/0105628 A1 5/2007 Arbogast et al.
2007/0111775 A1 5/2007 Yoseloff
2007/0111791 A1 5/2007 Arbogast et al.
2007/0111794 A1 5/2007 Hogan et al.
2007/0117608 A1 5/2007 Roper et al.
2007/0124483 A1 5/2007 Marples et al.
2007/0129145 A1 6/2007 Blackburn et al.
2007/0150329 A1 6/2007 Brook et al.
2007/0155490 A1 7/2007 Phillips et al.
2007/0167235 A1 7/2007 Naicker
2007/0191102 A1 8/2007 Coliz et al.
2007/0192748 A1 8/2007 Martin et al.
2007/0198418 A1 8/2007 MacDonald et al.
2007/0208816 A1 9/2007 Baldwin et al.
2007/0214030 A1 9/2007 Shear et al.
2007/0218998 A1 9/2007 Arbogast et al.
2007/0235521 A1 10/2007 Mateen et al.
2007/0241497 A1 10/2007 Soltys et al.
2007/0241498 A1 10/2007 Soltys
2007/0243925 A1 10/2007 LeMay et al.
2007/0243927 A1 10/2007 Soltys
2007/0243935 A1 10/2007 Huizinga
2007/0259709 A1 11/2007 Kelly et al.
2007/0259711 A1 11/2007 Thomas
2007/0287535 A1 12/2007 Soltys
2007/0298868 A1 12/2007 Soltys
2008/0004108 A1 1/2008 Klinkhammer
2008/0009344 A1 1/2008 Graham et al.
2008/0026832 A1 1/2008 Stevens et al.
2008/0026848 A1 1/2008 Byng
2008/0034317 A1* 2/2008 Fard et al. ..... 715/781
2008/0038035 A1 2/2008 Shuldman et al.
2008/0045341 A1 2/2008 Englman
2008/0045342 A1 2/2008 Crowder, Jr. et al.
2008/0045344 A1 2/2008 Schlottmann et al.
2008/0058105 A1 3/2008 Combs et al.
2008/0064501 A1 3/2008 Patel
2008/0065590 A1 3/2008 Castro et al.
2008/0076572 A1 3/2008 Nguyen et al.
2008/0090651 A1 4/2008 Baerlocher
2008/0096659 A1 4/2008 Kreloff et al.
2008/0102919 A1 5/2008 Rowe et al.
2008/0102932 A1 5/2008 Anderson et al.
2008/0108405 A1 5/2008 Brosnan et al.
2008/0108433 A1 5/2008 DiMichele et al.
2008/0113704 A1 5/2008 Jackson
2008/0113764 A1 5/2008 Soltys
2008/0113773 A1 5/2008 Johnson et al.
2008/0113793 A1 5/2008 Miyamoto et al.
2008/0117339 A1 5/2008 Kirsche
2008/0119284 A1 5/2008 Luciano, Jr. et al.
2008/0126803 A1 5/2008 Ginter et al.
2008/0127174 A1 5/2008 Johnson
2008/0138773 A1 6/2008 Lathrop
2008/0146337 A1 6/2008 Halonen et al.
2008/0153599 A1 6/2008 Atashband et al.
2008/0153600 A1 6/2008 Swarna
2008/0154916 A1 6/2008 Atashband
2008/0155665 A1 6/2008 Ruppert et al.
2008/0162729 A1 7/2008 Ruppert
2008/0165771 A1 7/2008 Gainey et al.
2008/0171588 A1 7/2008 Atashband

(56) References Cited

U.S. PATENT DOCUMENTS

| | | | |
|---|---|---|---|
| 2008/0171598 | A1 | 7/2008 | Deng |
| 2008/0200255 | A1 | 8/2008 | Eisele |
| 2008/0243697 | A1 | 10/2008 | Irving et al. |
| 2008/0244565 | A1 | 10/2008 | Levidow et al. |
| 2008/0261699 | A1 | 10/2008 | Topham et al. |
| 2008/0261701 | A1 | 10/2008 | Lewin et al. |
| 2008/0287197 | A1 | 11/2008 | Ruppert et al. |
| 2008/0293494 | A1 | 11/2008 | Adiraju et al. |
| 2008/0300046 | A1 | 12/2008 | Gagner et al. |
| 2008/0305854 | A1 | 12/2008 | Graham et al. |
| 2008/0311971 | A1 | 12/2008 | Dean |
| 2008/0313282 | A1 | 12/2008 | Warila et al. |
| 2008/0318655 | A1 | 12/2008 | Davies |
| 2008/0318671 | A1 | 12/2008 | Rowe et al. |
| 2008/0318685 | A9 | 12/2008 | Oak et al. |
| 2009/0005176 | A1 | 1/2009 | Morrow et al. |
| 2009/0005177 | A1 | 1/2009 | Kishi et al. |
| 2009/0011833 | A1 | 1/2009 | Seelig et al. |
| 2009/0029775 | A1 | 1/2009 | Ruppert et al. |
| 2009/0031008 | A1 | 1/2009 | Elliott et al. |
| 2009/0054139 | A1 | 2/2009 | Anderson |
| 2009/0063309 | A1 | 3/2009 | Stephens |
| 2009/0104977 | A1 | 4/2009 | Zielinski |
| 2009/0115133 | A1 | 5/2009 | Kelly et al. |
| 2009/0117994 | A1 | 5/2009 | Kelly et al. |
| 2009/0118001 | A1 | 5/2009 | Kelly et al. |
| 2009/0118005 | A1 | 5/2009 | Kelly et al. |
| 2009/0118006 | A1 | 5/2009 | Kelly et al. |
| 2009/0124329 | A1 | 5/2009 | Palmisano |
| 2009/0124392 | A1 | 5/2009 | Ruppert et al. |
| 2009/0124394 | A1 | 5/2009 | Swarna |
| 2009/0125603 | A1 | 5/2009 | Atashband et al. |
| 2009/0131144 | A1 | 5/2009 | Allen |
| 2009/0131163 | A1 | 5/2009 | Arbogast et al. |
| 2009/0132720 | A1 | 5/2009 | Ruppert et al. |
| 2009/0170594 | A1 | 7/2009 | Delaney et al. |
| 2009/0176556 | A1 | 7/2009 | Gagner et al. |
| 2009/0176578 | A1 | 7/2009 | Herrmann et al. |
| 2009/0176580 | A1 | 7/2009 | Herrmann et al. |
| 2009/0181776 | A1 | 7/2009 | Deng |
| 2009/0239667 | A1 | 9/2009 | Rowe et al. |
| 2009/0253483 | A1 | 10/2009 | Pacey et al. |
| 2009/0270170 | A1 | 10/2009 | Patton |
| 2009/0275393 | A1 | 11/2009 | Kisenwether et al. |
| 2009/0275394 | A1 | 11/2009 | Young et al. |
| 2009/0275398 | A1 | 11/2009 | Nelson |
| 2009/0275399 | A1 | 11/2009 | Kelly et al. |
| 2009/0275400 | A1 | 11/2009 | Rehm et al. |
| 2009/0275401 | A1 | 11/2009 | Allen et al. |
| 2009/0275402 | A1 | 11/2009 | Backover et al. |
| 2009/0275407 | A1 | 11/2009 | Singh et al. |
| 2009/0275410 | A1 | 11/2009 | Kisenwether et al. |
| 2009/0275411 | A1 | 11/2009 | Kisenwether et al. |
| 2009/0276341 | A1 | 11/2009 | McMahan et al. |
| 2009/0298583 | A1 | 12/2009 | Jones |
| 2009/0307069 | A1 | 12/2009 | Meyerhofer |
| 2009/0325708 | A9 | 12/2009 | Kerr |
| 2010/0016067 | A1 | 1/2010 | White et al. |
| 2010/0016068 | A1 | 1/2010 | White et al. |
| 2010/0029385 | A1 | 2/2010 | Garvey et al. |
| 2010/0048291 | A1 | 2/2010 | Warkentin |
| 2010/0058320 | A1 | 3/2010 | Milligan et al. |
| 2010/0062838 | A1 | 3/2010 | Nguyen et al. |
| 2010/0093440 | A1 | 4/2010 | Burke |
| 2010/0093441 | A1 | 4/2010 | Rajaraman et al. |
| 2010/0124990 | A1 | 5/2010 | Crowder |
| 2010/0125851 | A1 | 5/2010 | Singh et al. |
| 2010/0130280 | A1 | 5/2010 | Arezina et al. |
| 2010/0131772 | A1 | 5/2010 | Atashband et al. |
| 2010/0137056 | A1 | 6/2010 | Hoffman et al. |
| 2010/0151926 | A1 | 6/2010 | Ruppert et al. |
| 2010/0161798 | A1 | 6/2010 | Ruppert et al. |
| 2010/0210353 | A1* | 8/2010 | Gagner et al. ..... 463/25 |
| 2010/0234104 | A1 | 9/2010 | Ruppert et al. |
| 2010/0248842 | A1 | 9/2010 | Ruppert |
| 2011/0009184 | A1 | 1/2011 | Byng |
| 2011/0105206 | A1* | 5/2011 | Rowe ..... 463/9 |
| 2011/0111826 | A1 | 5/2011 | Baerlocher et al. |
| 2011/0124417 | A1 | 5/2011 | Baynes et al. |
| 2011/0161948 | A1 | 6/2011 | Hilbert |
| 2011/0179409 | A1 | 7/2011 | Yoseloff et al. |
| 2011/0269534 | A1 | 11/2011 | Kelly et al. |
| 2012/0110649 | A1 | 5/2012 | Murphy |
| 2012/0203692 | A1 | 8/2012 | Olliphant et al. |

FOREIGN PATENT DOCUMENTS

| | | | |
|---|---|---|---|
| EP | 0 700 980 | B1 | 11/1999 |
| EP | 1074955 | A2 | 2/2001 |
| EP | 1463008 | A2 | 9/2004 |
| GB | 2 370 791 | A | 7/2002 |
| GB | 2380143 | A | 4/2003 |
| JP | 8255059 | | 10/1996 |
| KR | 2001-0084838 | | 9/2001 |
| KR | 2002-0061793 | | 7/2002 |
| KR | 2003-0091635 | | 12/2003 |
| WO | 97/36658 | A1 | 10/1997 |
| WO | 00/22585 | A2 | 4/2000 |
| WO | 02/05914 | A1 | 1/2002 |
| WO | 03/060846 | A2 | 7/2003 |
| WO | 2005/035084 | | 4/2005 |
| WO | 2006/110348 | | 10/2006 |
| WO | 2007/033207 | A2 | 3/2007 |

OTHER PUBLICATIONS

"GSA Point-to-Point SOAP/HTTPS Transport and Security Specification v1.0.3," Gaming Standards Association Transport Technical Committee, 16 pages, Jun. 5, 2007.

Bally Technologies, Inc., iVIEW, http://ballytech.com/systems/product.cfm?id=9, download date Nov. 6, 2007, 2 pages.

Bally TMS, "MP21—Automated Table Tracking/Features," 2 pages, Nov. 2005.

Bally TMS, "MPBacc—Specifications/Specifications," 2 pages, Nov. 2005.

Bally TMS, "MPLite—Table Management System/Features," 2 pages, Nov. 2005.

Bulavsky, "Tracking the Tables," *Casino Journal*, May 2004, pp. 44-47, accessed Dec. 21, 2005, URL=http://www.ascendgaming.com/cj/vendors_manufacturers_table/Trackin916200411141AM.htm, 5 pages.

Burke, "Tracking the Tables," reprinted from *International Gaming & Wagering Business*, Aug. 2003, 4 pages.

Gros, "All You Ever Wanted to Know About Table Games," reprinted from *Global Gaming Business*, Aug. 1, 2003, 2 pages.

Hung et al., "Performance Evaluation of the Least Conflict Sharable Spreading Code Assignment Algorithm," IEEE, 1996, 5 pages.

MagTek, "Port Powered Swipe Reader," Technical Reference Manual, Manual Part No. 99875094 Rev 12, Jun. 2003, 20 pages.

Mikohn, "Tablelink™, The New Standard in Table Games," before Jan. 1, 2004, 14 pages.

Olesiejuk, "Discovery Services for Gaming Devices on a Casino Floor," Gaming Standards Association, 3 pages, Mar. 12, 2007.

Terdiman, "Who's Holding the Aces Now?", reprinted from *Wired News*, Aug. 18, 2003, 2 pages.

Winkler, "Product Spotlight: MindPlay," reprinted from *Gaming and Leisure Technology*, Fall 2003, 2 pages.

International Search Report and Written Opinion, mailed Dec. 22, 2009, for PCT/US2009/042149, 6 pages.

Kisenwether et al."Systems, Methods, and Devices for Providing Instances of a Secondary Game," Office Action mailed Jun. 28, 2011, for U.S. Appl. No. 12/112,740, 20 pages.

Crowder, "Apparatus, Method, and System to Provide a Multiple Processor Architecture for Server-Based Gaming," Amendment dated Aug. 5, 2011 for U.S. Appl. No. 12/271,736, 18 Pages.

Crowder, "Apparatus, Method, and System to Provide a Multiple Processor Architecture for Server-Based Gaming," Office Action dated May 5, 2011 for U.S. Appl. No. 12/271,736, 10 Pages.

(56) References Cited

OTHER PUBLICATIONS

Crowder, "Apparatus, Method, and System to Provide a Multiple Processor Architecture for Server-Based Gaming," Office Action dated Nov. 7, 2011 for U.S. Appl. No. 12/271,736, 11 Pages.
Crowder, "Apparatus, Method, and System to Provide a Multiple Processor Architecture for Server-Based Gaming," Notice of Allowance dated May 16, 2012, for U.S. Appl. No. 12/271,736, 9 pages.
Kisenwether, Joseph et al., "Systems, Methods, and Devices for Providing Instances of a Secondary Game," Amendment dated Sep. 28, 2011 for U.S. Appl. No. 12/112,740, 14 Pages.
Kisenwether, Joseph et al., "Systems, Methods, and Devices for Providing Instances of a Secondary Game," Amendment dated Mar. 21, 2012 for U.S. Appl. No. 12/112,740, 14 Pages.
Kisenwether, Joseph et al., "Systems, Methods, and Devices for Providing Instances of a Secondary Game," Amendment dated Aug. 2, 2013 for U.S. Appl. No. 12/112,740, 15 Pages.
Kisenwether, Joseph et al., "Systems, Methods, and Devices for Providing Instances of a Secondary Game," Office Action dated Jun. 28, 2011 for U.S. Appl. No. 12/112,740, 20 Pages.
Kisenwether, Joseph et al., "Systems, Methods, and Devices for Providing Instances of a Secondary Game," Office Action dated Dec. 21, 2011 for U.S. Appl. No. 12/112,740, 16 Pages.
Kisenwether, Joseph et al., "Systems, Methods, and Devices for Providing Instances of a Secondary Game," Office Action dated Apr. 2, 2013 for U.S. Appl. No. 12/112,740, 20 Pages.
Kisenwether, Joseph et al., "Systems, Methods, and Devices for Providing Instances of a Secondary Game," Office Action dated Nov. 7, 2013 for U.S. Appl. No. 12/112,740, 10 Pages.
Kisenwether, Joseph et al., "Systems, Methods, and Devices for Providing Instances of a Secondary Game," Response dated Jan. 7, 2014 for U.S. Appl. No. 12/112,740, 16 Pages.
Singh et al., "Apparatus, Method, and System to Provide a Multi-Core Processor for an Electronic Gaming Machine (EGM)," Advisory Action dated Jul. 25, 2012, for U.S. Appl. No. 12/271,337, 4 pages.
Singh et al., "Apparatus, Method, and System to Provide a Multi-Core Processor for an Electronic Gaming Machine (EGM)," Amendment dated Mar. 7, 2012, for U.S. Appl. No. 12/271,337, 11 pages.
Singh et al., "Apparatus, Method, and System to Provide a Multi-Core Processor for an Electronic Gaming Machine (EGM)," Amendment dated Jul. 16, 2012, for U.S. Appl. No. 12/271,337, 8 pages.
Singh et al., "Apparatus, Method, and System to Provide a Multi-Core Processor for an Electronic Gaming Machine (EGM)," Amendment dated Aug. 16, 2012, for U.S. Appl. No. 12/271,337, 8 pages.
Singh et al., "Apparatus, Method, and System to Provide a Multi-Core Processor for an Electronic Gaming Machine (EGM)," Office Action dated Dec. 7, 2011, for U.S. Appl. No. 12/271,337, 9 pages.
Singh et al., "Apparatus, Method, and System to Provide a Multi-Core Processor for an Electronic Gaming Machine (EGM)," Office Action dated Mar. 16, 2012, for U.S. Appl. No. 12/271,337, 10 pages.
Singh et al., "Apparatus, Method, and System to Provide a Multi-Core Processor for an Electronic Gaming Machine (EGM)," Notice of Allowance dated Aug. 30, 2012, for U.S. Appl. No. 12/271,337, 7 pages.
Gwyddion User Guide, "False Color Mapping: Chapter 3. Getting Started," retrieved from URL=http://sourceforge.net/projects/gwyddion/files/user-guide/2007-06-28/gwyddion-user-guide-xhtml-2007-06-28.tar.gz/download, retrieved on Nov. 21, 2012, 2 pages.
Requirements document, "Game Authentication Terminal Program (GAT3)," to Gaming Standards Association, Aug. 2005, 27 pages.
Standards document, "Technical Standards for Gaming Devices and On-Line Slot Systems," to Nevada Gaming Commission and State Gaming Control Board, Aug. 17, 2005, 15 pages.

* cited by examiner

APPARATUS, METHOD, AND SYSTEM TO PROVIDE A MULTIPLE PROCESSOR ARCHITECTURE FOR SERVER-BASED GAMING

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

1. Field of the Invention

This disclosure generally relates to gaming devices, and more particularly but not exclusively, relates to electronic gaming machines (EGMs).

2. Description of the Related Art

Gaming properties often devote a large percentage of floor space to gaming devices. Each gaming device presents players with individual games of chance, games of skill, or combinations thereof that they may wager on.

In modern gaming properties, many gaming devices are in the form of electronic gaming machines (EGMs) that may include specialized computing devices or specially programmed general purpose computing devices along with user input and output interfaces and financial transaction components. These EGMs have been subject to ever greater computational demands. Each EGM may provide, inter alia, the following: offer a number of graphics-intensive games of chance and associated bonus games to players; communicate via a network with one or more servers within the gaming property; display the content of one or more web pages; receive and process currency of various types inserted by players; display targeted advertisements and other audiovisual content to players; process and store information indicative of wagers made by players; and so forth. As these computational demands have continued to multiply, the computational power provided in each EGM has needed to be increased in order to enable more and more functionality.

However, existing solutions to address the computational demands have often been unsatisfactory and/or have needed improvement.

BRIEF SUMMARY OF THE INVENTION

A method of operating a multi-processor architecture in an electronic gaming environment may be summarized as including: providing a first processor to execute a logic engine for a game; providing a second processor to execute only a presentation engine for said game; executing by said first processor said logic engine to process player input to obtain an outcome pertaining to said game; sending, by said first processor to said second processor, a control signal that corresponds to said outcome; and executing, by said second processor in response to said control signal sent by said first processor, said presentation engine to present said outcome.

A multi-processor system in an electronic gaming environment may be summarized as including: a first processor adapted to execute a logic engine for a game; a second processor adapted to execute only a presentation engine for the game; a first processor-readable storage medium coupled to the first processor and that stores a first set of processor-executable instructions that implement the logic engine, the first set of processor-executable instructions being executable by the first processor to process player input to obtain an outcome pertaining to the game; a communication line coupled to the first and second processors, and adapted to be used by the first processor to send to the second processor a control signal that corresponds to the outcome; and a second processor-readable storage medium coupled to the second processor and that stores a second set of processor-executable instructions that implement the presentation engine, the second set of processor-executable instructions being executable by the second processor in response to the control signal sent by the first processor to present the outcome.

An electronic gaming machine (EGM) apparatus may be summarized as including: at least one processor adapted to execute only a presentation engine for a game, wherein another processor is adapted to execute a logic engine for the game; and a processor-readable storage medium coupled to the at least one processor and that stores a set of processor-executable instructions that implement the presentation engine, the set of processor-executable instructions being executable by the at least one processor to present an outcome pertaining to the game, in response to a control signal received from the another processor and generated by the another processor in response to application of the logic engine to player input.

A server apparatus in an electronic gaming environment may be summarized as including: at least one processor adapted to execute a game logic engine for a game, wherein another processor is adapted to execute only a presentation engine for the game; and a processor-readable storage medium coupled to the at least one processor and that stores a set of processor-executable instructions that implement the game logic engine, the set of processor-executable instructions being executable by the at least one processor to obtain an outcome pertaining to the game in response to player input, the at least one processor being adapted to generate a control signal corresponding to the outcome and to send the control signal to the another processor to enable the another processor to execute the presentation engine to present the outcome.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

DETAILED DESCRIPTION OF THE EMBODIMENTS OF THE INVENTION

Figure 1:
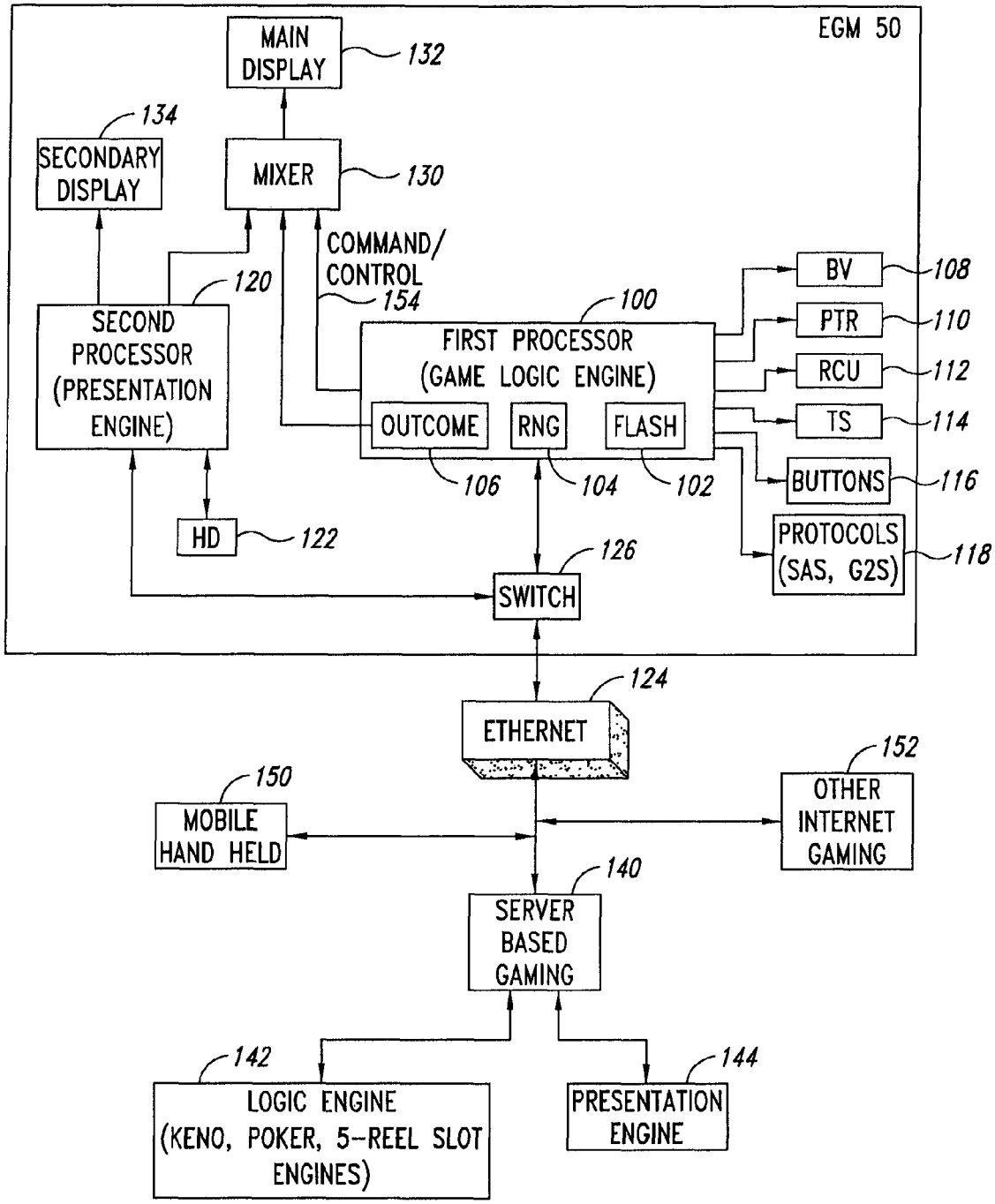
FIG. 1 is a block diagram of one embodiment of a multi-processor architecture for an EGM.

In the following description, numerous specific details are given to provide a thorough understanding of embodiments.

The embodiments can be practiced without one or more of the specific details, or with other methods, components, materials, etc. In other instances, well-known structures, materials, or operations are not shown or described in detail to avoid obscuring aspects of the embodiments.

Reference throughout this specification to "one embodiment" or "an embodiment" means that a particular feature, structure, or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

Unless the context requires otherwise, throughout the specification and claims which follow, the word "comprise" and variations thereof, such as, "comprises" and "comprising" are to be construed in an open, inclusive sense, that is, as "including, but not limited to."

As used in this specification and the appended claims, the singular forms "a," "an," and "the" include plural referents unless the context clearly dictates otherwise. It should also be noted that the term "or" is generally employed in its sense including "and/or" unless the context clearly dictates otherwise.

The headings provided herein are for convenience only and do not interpret the scope or meaning of the embodiments.

As an overview, one embodiment provides an architecture for an electronic gaming machine (EGM) environment, comprising multiple processors that separate a game's input/output (I/O) handling (e.g., game logic) from the game's presentation handling. The multi-processor architecture includes a dedicated I/O (e.g., game logic) engine and a dedicated presentation engine. A first processor is dedicated to handle the I/O, peripherals, communications, accounting, critical gaming and other game logic, power hit tolerances, protocols to other systems, and other tasks related to operation of the EGM. A second processor is dedicated to running a presentation engine only. The second processor of one embodiment can be part of a thin-client (or a smart thin client having local presentation code and graphics that can be downloaded and updated), and receives commands from the first processor to present game-oriented outcome and results.

Such embodiments would be useful in gaming properties, such as casinos having multiple EGMs from different manufacturers, where one manufacturer's game cannot be installed in another manufacturer's EGM. By separating the game logic engine from the presentation engine, flexibility is provided by one embodiment to allow selection of any suitable presentation engine that can be executed using a multimedia-friendly operating system. Since a majority of the manufactured EGMs have a typical game logic engine installed for controlling the I/O and downloads to all peripherals, one embodiment enables the corresponding presentation engine to be selected from a choice of available products, which may be provided by other parties/manufacturers.

One embodiment of the multi-processor architecture supports gaming growth, by way of its separation of the presentation logic from the game logic, thereby providing a migration path from a restrictive EGM environment in which there are incompatible and disparate EGMs that each provide their own proprietary game logic engine and presentation engine, to a future casino floor with third parties developing the presentation engines. A potential result of one embodiment is to provide a casino in which the EGMs have a common first processor for game logic and a choice in presentation engines. Such a casino would therefore be less reliant on proprietary games and networks, and there would be less need to buy multiple EGMs from one manufacturer. Thus, one embodiment meets the challenge in the gaming industry of providing an architecture that is adaptive to the regulatory and technology environment, by creating a common gaming network that can use less-expensive third party presentation engine developers.

In addition to providing a migration path away from the existing environment of EGMs having just one processor and proprietary game logic and graphics, one embodiment of the multi-processor architecture can be integrated with server-based gaming elements. For example, one embodiment of a hybrid fat/thin client with which the multi-processor architecture can be implemented is described herein.

One embodiment of the multi-processor architecture also addresses the deficiencies of previous EGM implementations, in which a first processor drove the peripherals and I/O and a second processor driving the multimedia did not do presentation alone, but also did accounting, hit tolerances, and critical gaming operations. As such, the second processor was a gaming device in itself. Such previous implementations required both processors to operate in synchronization. In contrast with one embodiment of the multi-processor architecture, the second processor is dedicated to driving the presentation only, while the first processor is independent of the second processor and is used for the game logic.

For the sake of simplicity and convenience, embodiments will be described herein in the context of a "multi-processor" implementation (such as a "dual-processor" system), rather than in the context of a "multi-core processor" implementation (such as a "dual-core processor" configuration). Dual-processor (DP) systems, for example, are generally those that contain two separate physical processors in the same (or different) chassis. In DP systems such as with the embodiments described herein, the two processors can either be located on the same motherboard or on separate boards. In comparison, for an example dual-core processor configuration, an integrated circuit (IC) contains two complete processor cores. The two processor cores may be manufactured so that they reside side-by-side on the same die, each with its own path to a system front-side bus.

In other embodiments, a multi-core processor implementation (such as a dual-core processor configuration) can be provided, in which a first processor core runs the game logic and a second processor core runs the presentation. Examples of a multi-core processor implementation in an EGM are described in U.S. patent application Ser. No. 12/271,337, entitled "APPARATUS, METHOD, AND SYSTEM TO PROVIDE A MULTI-CORE PROCESSOR FOR AN ELECTRONIC GAMING MACHINE (EGM)," filed concurrently herewith, assigned to the same assignee as the present application, and incorporated herein by reference in its entirety.

Further for the sake of simplicity of explanation and convenience, various embodiments will be described herein in the context of dual-processor architecture. In other embodiments of the multi-processor architecture, more than two processors may be used.

FIG. 1 is a block diagram of the one embodiment of a system that includes an EGM 50 having a multi-processor architecture. The EGM 50 may be located within a gaming property (not shown) comprising any of a variety of establishments housing one or more EGMs used for gaming/gambling. In one embodiment, the EGM 50 may be located within a casino. However, places such as convenience stores, hotels, gas stations, supermarkets, or other establishments that are capable of housing the EGM 50 may be considered as gaming property.

The EGM 50 may be adapted to run any one or more of a variety of games of chance, games of skill, or combinations thereof that a player may wager on. Such games may include, but not be limited to, video slot machines, video keno, video poker, video blackjack, Class II bingo, lottery, craps, a mechanical or video representation of a wheel game, etc. In one embodiment, the EGM 50 is a single-offering EGM, enabling play of only one game. However, in other embodiments, the EGM 50 is relatively flexible, allowing a player to choose from among a number of games.

As shown in FIG. 1, the EGM 50 includes a first processor 100 adapted to run a game logic engine. The first processor 100 of one embodiment can comprise a "low-end" central processing unit (CPU) or any other type of processor capable of executing game logic and managing peripherals. The game logic engine of one embodiment can be in the form of a software application or other processor-executable instructions executable by the first processor 100. The game logic engine can also be embodied as hardware, and/or as a combination of hardware and processor-executable instructions.

The first processor 100 is provided with a processor-readable storage unit (such as a compact flash 102), a random number generator (RNG) 104, and an outcome unit 106. The first processor 100 of one embodiment is adapted to manage peripherals that may include: a bill validator (BV) 108, a printer (PTR) 110, a reel control unit (RCU) 112, a touch-screen (TS) 114, buttons 116, protocols (such as SAS and G2S) 118, and a USB or other peripheral/network connection (not shown).

The EGM 50 of one embodiment includes a second processor 120 adapted to run a presentation engine. The presentation engine of one embodiment can also be in the form of a software application or other processor-executable instructions executable by the second processor 120. The presentation engine can also be embodied as hardware, and/or as a combination of hardware and processor-executable instructions.

The second processor 120 of one embodiment can comprise part of a game console, such as an Xbox or other gaming unit. The second processor 120 is coupled to a processor-readable storage medium (such as a hard disk 122) to execute processor-executable instructions stored thereon, which may include the presentation engine, and may also be coupled to a peripheral/network connection, such as a USB connection (not shown). In one embodiment, the first processor 100 may also be coupled to a different or same processor-readable storage medium (e.g., the same hard disk 122) in order to execute processor-executable instructions stored thereon, which may include the game logic engine. Together with the first processor 100, the second processor 120 is coupled to a network (such as an Ethernet 124) by a switch 126.

Both the first processor 100 and the second processor 120 are coupled to and use a mixer 130 to drive a main display 132, with the second processor 120 also having connection to a secondary display 134. By way of the Ethernet 124, the EGM 50 can be communicatively coupled to a back-end server 140 for server-based gaming, for communicating control and accounting information, for receiving downloads, and so forth. The back end server 140 may include or is coupled to a game logic engine(s) 142 and a presentation engine(s) 144. Other devices that may be communicatively coupled to the Ethernet 124 can include wireless hand-held devices 150 (usable for mobile gaming, for example) and other Internet gaming devices 152.

In one embodiment, the first processor 100 and related elements includes hardware similar to the iView product of Bally Technologies, Inc., less its display. Given that the iView product or other similar products have been developed as a gaming device with an ability to run Windows CE, Linux, or any ported operating system, the hardware of the first processor 100 is programmed to manage peripherals, accounting, etc., with its code stored in the compact flash 102. Of course, other embodiments can be provided in which the first processor 100 and related elements includes hardware that are different than the iView product.

FIG. 1 shows that one embodiment of the multi-processor architecture separates the game logic engine from the presentation engine. The first processor 100 runs the game logic engine, and the second processor 120 runs the presentation engine only, with the hard disk 122 being used to store the multimedia assets and further not being used to store anything of integrity or critical in nature. In another embodiment, the second processor 120 can be adapted to perform other tasks that may not necessarily be related to the presentation engine.

The switch 126, which may be located physically inside the EGM 50, is secure and is used to isolate the traffic between the first processor 100 and the second processor 120 from the rest of the Ethernet 124. The Ethernet 124 of one embodiment is made secure through the use of certificates for communications.

Activation (e.g., pushes) of the touch screen 114 and button 116 and responses thereto are managed by the first processor 100. As data is received by the first processor 100, the data are sent over using a communication protocol to the second processor 120 for display. A hypothetical game illustrates the interaction between the second processor 120 and the first processor 100 according to one embodiment:

First, a game patron (player) presses a button (e.g., one of the buttons 116) on the game console of the second processor 120 or EGM 50 to initiate play, such as a bet on a game. A command is transferred to the first processor 100 to initiate the request to play the game. The first processor 100 determines if the player has the credit to make the bet and to commit the requested credits, and returns a signal to the second processor 120 to display an update to the player's credit balance on the main display 132. The player next presses a start button, which then sends a command to the first processor 100 to request playing of a game of poker for the bet amount. The first processor 100 verifies that the player has placed a wager for the credits, and using the random number generator (RNG) 104 draws the results. The pay table, which is part of the outcome unit 106, is evaluated, and these evaluated poker cards by the pay table are sent back to the second processor 120 by the first processor 100. The second processor 120 displays on the main display 132 the poker game and its cards to the player, who then selects which cards to hold, and a press of a draw button by the player sends another command back to the first processor 100 to indicate the player has selected cards and is ready to draw. The RNG 104 pulls the remaining draw cards, and with the final outcome evaluated, the cards are returned to the second processor 120 for display to the player on the main display 132.

A feature of one embodiment of the multi-processor architecture is that for security reasons, all the critical gaming functionality is isolated on the first processor 100. This security feature is different from what been done before with conventional EGMs.

Another feature of one embodiment of the multi-processor architecture, with its separation of the presentation logic from the game logic, is a built-in migration path. In a manner that moves away from conventional EGMs having one processor and proprietary operating/graphics system, which has drawbacks, there is provided by an embodiment a migration to a configuration having a dedicated I/O (game logic) and a dedicated presentation via separated engines, and with possible movement of the two engines to the back-end server 140 for server-based gaming. Additionally, one embodiment allows for third party presentation engine development, and for the addition of other platforms with different presentation, including Internet gaming, in-room gaming, and hand-held mobile gaming.

Other features provided by one embodiment include management of the main display 132. The second processor 120 has video output to be displayed, and the first processor 100 also has video output to be displayed. Both video outputs connect through the mixer 130, which drives the main display 132. The mixer 130 allows the first processor 100 to still display video output on the main display 132 even if there is a problem with the second processor 120.

According to one embodiment, while the first processor 100 is displaying information on a back-end system, the second processor 120 is allowed to continue to display information on the main display 132. The second processor 120 remains in charge of the main display, 132 with an optional window display screen (e.g., the secondary display) to provide players with variety of gaming options.

Figure 2:
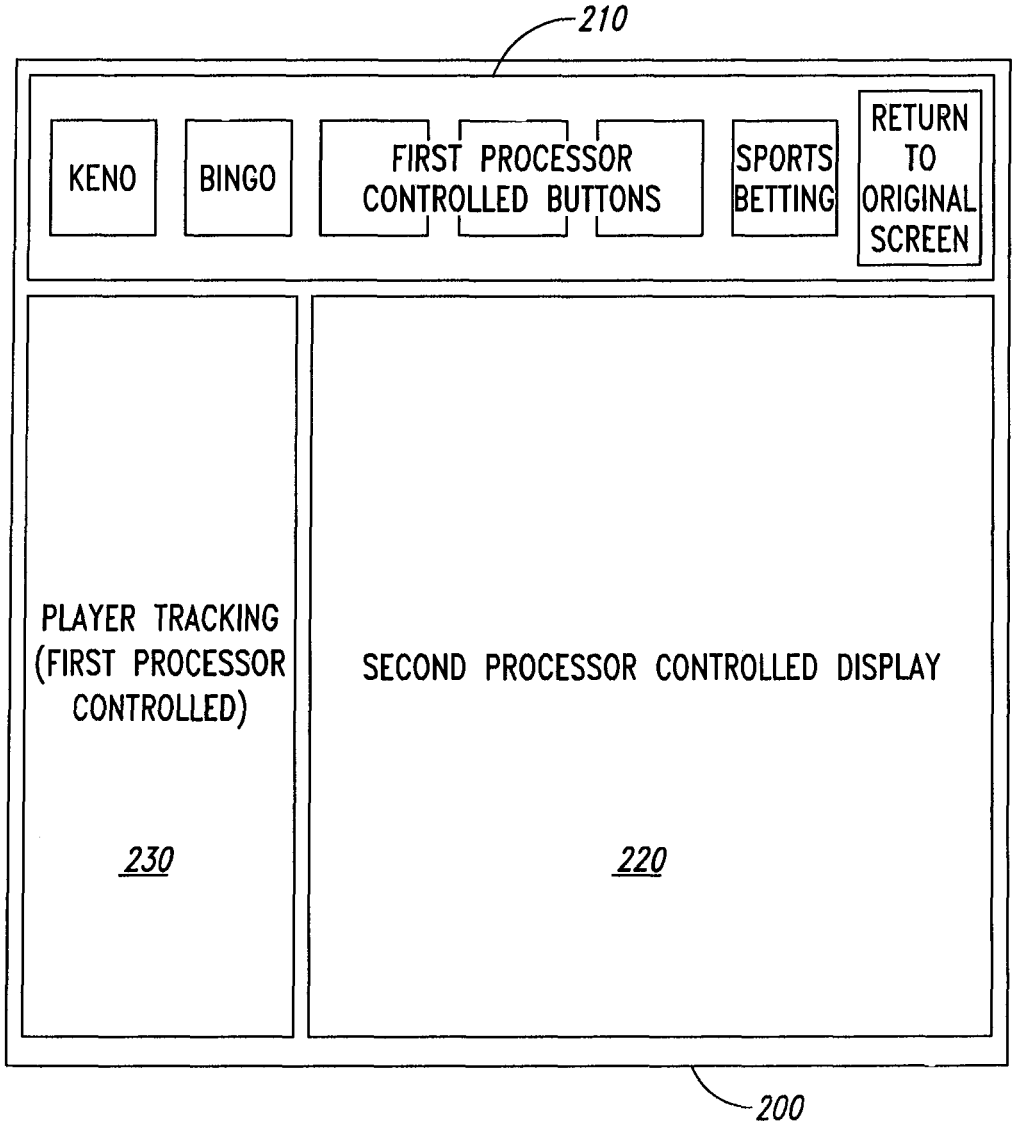
FIG. 2 shows an example display layout for the EGM of FIG. 1 according to one embodiment.

An example screen display layout associated with the second processor 120 is illustrated in FIG. 2. In FIG. 2, a game display 200 (which may be presented via the main display 132) has its top portion 210 managed by the first processor 100, where there is a variety of buttons, such as keno, bingo, sports betting, and a default button to return the screen to full display (such as a display of the presentation provided by the second processor 120). Underneath this top portion 210 and to the right is a display area 220 controlled by the second processor 120, and to the left is a player game screen area 230 controlled by the first processor 100. By default, the player game screen area 230 may for example display player tracking information. The display area 220 can be game-centric, without knowledge or ability to manage the other system functionality, given that system functionality is managed by the first processor 100.

The game screen area 230 is adapted to display a variety of content depending on specific button pushes that occur in the top portion 210. For example, if the player desires to purchase Keno ticket, a press of the Keno button in the top portion 210 displays "Keno" in the game screen area 230 so that the player may buy a ticket for the Keno game.

One embodiment also addresses the issue of how to display tilts and critical errors where there are two processors and only one main display 132. In a situation where the main display 132 is controlled by the second processor 120 only, then for each time that the first processor 100 needs to display content on the main display 132, the first processor 100 would be required to send commands across the Ethernet 124 to the second processor 120 to request a display. The second processor 120, while not containing any critical gaming functionality and having only media presentation capabilities, would therefore require having a sequence of commands programmed into it in order to be able to display requests from the first processor 100. If a problem in the EGM 50 occurs for which display requests have not been specifically programmed in the second processor 120, then the first processor 100 would not have access to the main display 132 in order to provide an alert of the problem.

Accordingly to address such a situation, one embodiment provides the first processor 100 with a separate communication channel 154 to the mixer 130, such that the first processor 100 controls both the mixer 130 and its own display. Such a feature enables the first processor 100 to mix its own content (such as displayed in the player game screen area 230) and to display its own critical messages, if necessary. For example, if a tilt comes out of the bill validator 108, causing loss of communication, the first processor 100 is able to send a command to the mixer 130 to implement a tilt screen window overlay. The overlay can be in the form of a center box displayed on the display area 220, and text or information regarding the tilt condition that has occurred on the EGM 50 is presented inside that box.

Figure 3:
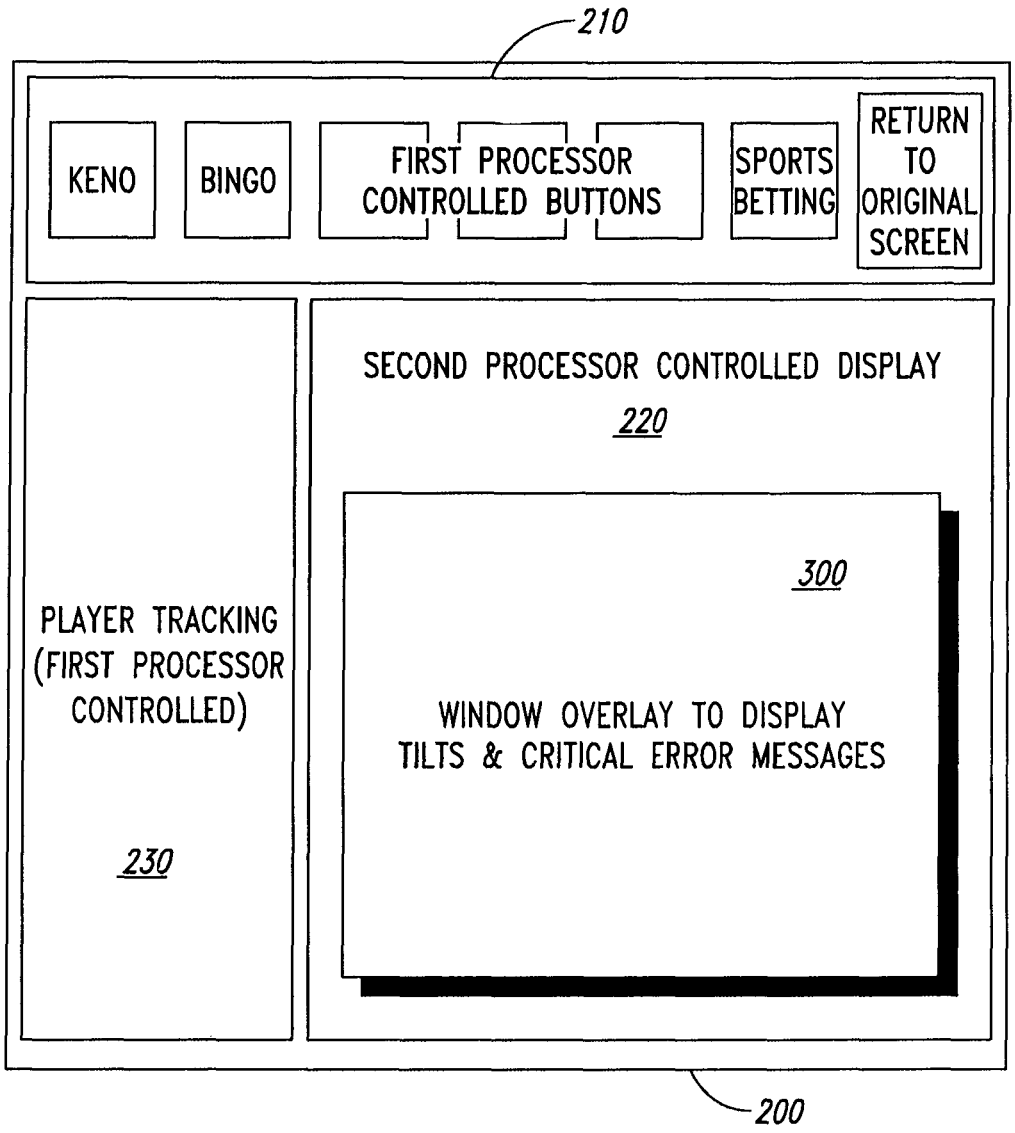
FIG. 3 shows another example display layout for the EGM of FIG. 1 according to one embodiment.

FIG. 3 illustrates the display area 220 with a window overlay 300 to display tilts and critical error messages. In FIG. 3, the game display 200 has the window overlay 300, with the window overlay being inside the display area 220, so as to show how a problem (if it occurs) is displayed to the player. Additionally, the first processor 100 can be enabled to minimize or expand the game display window 200 through the mixer 130, if appropriate.

In one embodiment, the second processor 120 can be provided with access to the secondary display 134. This access may be direct or may be run through the mixer 130.

A feature of the embodiment(s) described above is that the first processor 100 is a more robust embedded system and secure through an operating system (such as Linux), customized to intercept problem signals, and as such is unlikely to go down. Therefore, the first processor 100 can display error conditions even if there is a critical operating system problem, and regardless of the second processor 120, can display any error. The second processor 120 need not have exclusive control over the mixer 132 and as such only displays its own video or other content.

In one embodiment, the mixer 130 is embedded on a mother board itself. The mixer 130 does not necessitate a separate physical component, such that an ASIC chip can be designed to solely run the mixer 130 logic.

Figure 4:
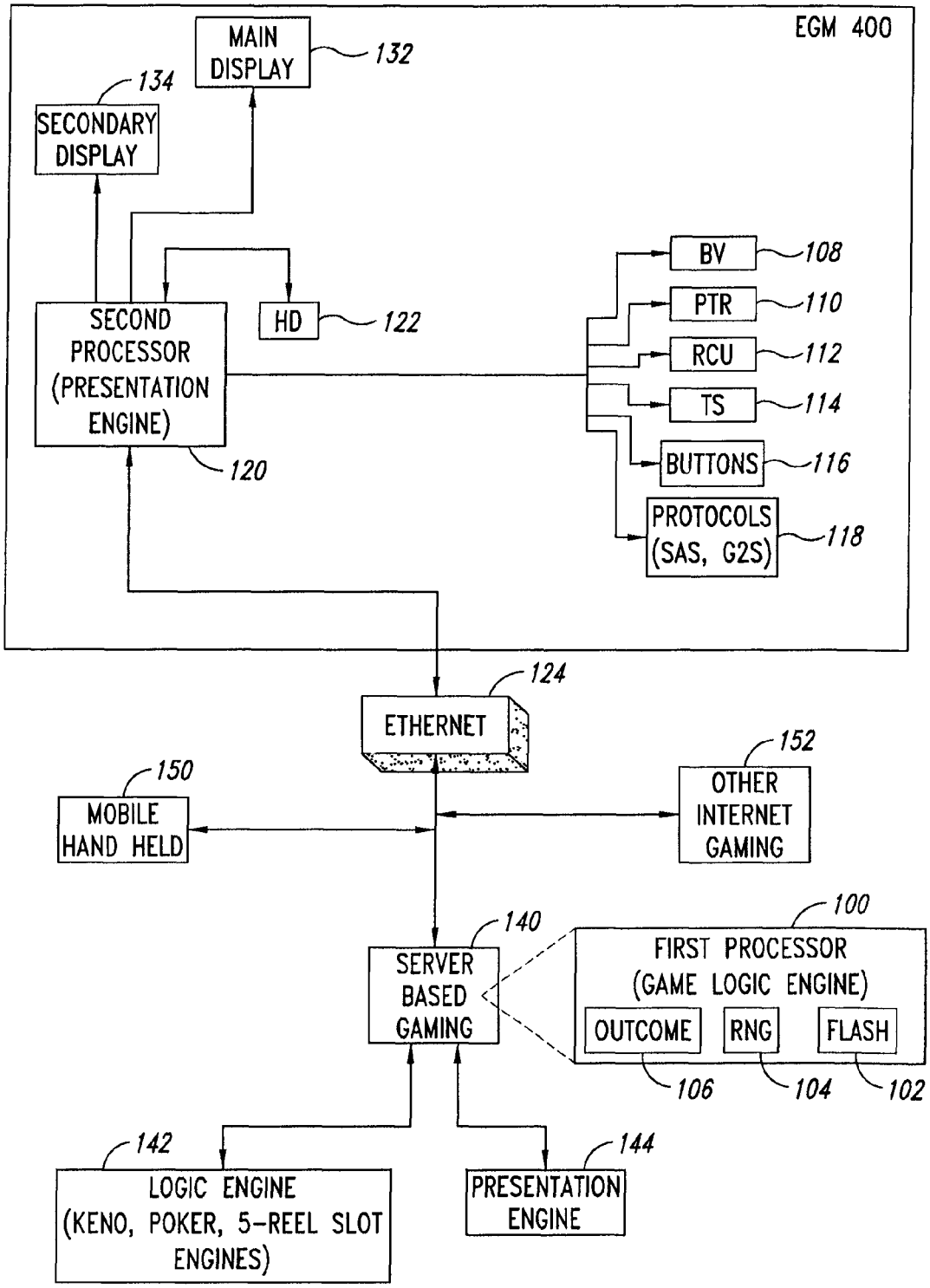
FIG. 4 is a block diagram of another embodiment of a multi-processor architecture for an EGM.

In one embodiment that implements server-based gaming (SBG), the outcome unit 106, the RNG 104, pay-tables, game logic, accounting, and the critical gaming functionality of the first processor 100 can be located at the back-end server 140. Such an SBG embodiment is shown in FIG. 4.

The second processor 120 (and its associated game console) may remain in an EGM 400 to enable the displaying of content, and the second processor 120 may be enhanced to control the I/O, the buttons 116, or to at least process the touch screen 114 and the inputs applied thereto. Additionally, with this "thinner" client configuration, the mixer 130 may not be necessary.

The server 140 may use its presentation engine 144 and game logic engine 142, alternatively or additionally to the engines provided by the second processor 120 and the first processor 100, to provide game functionality. In other embodiments, the presentation engine 144 and/or the game logic engine 142 may be downloaded from the server 140 to the respective processors of the EGM or other client device.

In another embodiment for the SBG, the first processor 100 may be kept at the EGM 400, except that the outcome unit 106 is located remotely in the server 140. The first processor 100 remains in the EGM 400 to manage some peripherals, such as for example if the second processor 120 malfunctions.

In an SBG embodiment, the server 140 is able to download content and/or commands to the EGM, and the gaming is still split into two engines: the logic engine 142 (and/or the logic engine of the first processor 100) and the presentation engine 144 (and/or the presentation engine of the second processor 120). Game developers can then develop game modules for the two engine parts, and incorporate any libraries between them.

With the logic engine 142 (and/or the logic engine of the first processor 100) responsible for the outcome, pay-tables, game logic, accounting, and all the critical gaming functionality, one embodiment can provide separate logic engines specific for each game type. For example, there can be Keno engines, poker engines, 5-reel slot engines, such that these engines manage all the logic for these game types. Therefore, if an EGM has 20 different games, there may be 20 associated logic engines that can be provided, given that each game may be different and may require its own engine.

In one embodiment, the presentation engine 144 layout is such that it is in a one-to-one correlation with the logic engine 142. Through a download feature of one embodiment, the presentation engine(s) 144 may be downloaded to the second processor 120, such as if the second processor 120 does not yet have a presentation engine installed therein and/or if additional presentation engines are needed. The game logic engine(s) 142 may be kept for use at the server 140 and/or downloaded to the first processor 100, if the EGM 50/400 has the first processor 100 located therein.

Separating the game logic and the game presentation into the two engines enables the workload to be separated. Regulated gaming companies can then manage and write the code or other processor-executable instructions for the logic engines, and third-party companies can create the presentation engines. Since the presentation engines of one embodiment do not include any critical gaming functionality, third-party development of games based on familiar gaming platforms is facilitated. This is a flexible architecture that may be adapted into many future configurations.

One embodiment that demonstrates this flexibility is mobile gaming via use of the wireless hand-held device 150. With a SBG implementation that uses the two separated engines (e.g., the presentation engine 144 and the logic engine 142), the hand held device 150 provides a display (such as a touch screen display) and is a thin client similar somewhat similar to the game console that includes the second processor 120, but may have a different presentation engine. The logic engine 142 may be the same for every device (whether a stationary EGM or the wireless hand-held device 150), but the presentation engine may be different depending upon the target platform destination, for example an Xbox poker and a Windows CE hand held poker presentation engine. The presentation engine(s) 144 can be customized for the desired target platform. In this example, the wireless hand-held device 150 may download a particular presentation engine 144 suitable for its requirements from the server 140, if the wireless hand-held device 150 does not yet have a suitable presentation engine installed therein.

For the Internet gaming device 152, a web browser with Active X controls that allows downloading may be installed therein, for example. The Internet gaming device 152 may use yet another (different) presentation engine 144, downloaded from the server 144, to drive the game content through its web browser. Even though there may be several different presentation engine platforms for the devices 150 and 152, the logic engine 142 of the server 140 may nevertheless be provided to drive the critical gaming functionality, accounting, recovery, etc.

A feature of one embodiment is that the first processor 100 may be a relatively inexpensive processor, and the second processor 120 and its accompanying game console may also be reasonably priced items. In one embodiment where the first processor 100 controls the hardware, proximity detection capability to locate casino players on the casino floor can be provided within the first processor 100 and/or with the hardware that it controls.

Another embodiment of the multi-processor architecture can be used where multiple operating systems are executing on one EGM. With such multiple processors present in one device, the graphics video card can be driven and the presentation can be executed with an operating system on one or more processors, and the remaining processors with their operating systems can drive the I/O and any game requirements/logic. The separation of the game logic and presentation logic still remains. The processor-executable code for the game logic and all the software may run on an operating system such as Linux, while the presentation can run on Microsoft Windows or other operating system that is multimedia friendly.

Another embodiment provides a hybrid fat/thin client, or "smart" client. Such smart clients can be in the form of EGMs that have an ability to download and maintain the configurations described herein (e.g., separation of game logic from game presentation) while remaining connected with the back-end server 140. These EGMs are neither only a fat client nor only a thin client with a browser. A fat client is generally a device that has all the code and the outcome determined on the EGM, with only information sent to the server, which may be undesirable in some situations. A thin client is generally a device with a limited processor and a browser, and may not be desirable in situations where a slow network or traffic congestion is present. Further, a thin client has diminished presentation, and a web browser limits the ability to display graphics that take full advantage of the hardware. Thus, if game players suspect that a thin-client EGM is not behaving normally, then the players might move to another EGM.

In comparison to fat clients and thin clients, a smart client can download the presentation, and has the architecture as defined above where the game logic is separated from the presentation. The logic engine can remain on the back-end server 140, and the presentation is downloaded, with the presentation code able to run in a browser of the smart client. The presentation code could also be C++ code, for example, or any embedded technology coding optimized to take full advantage of the hardware and give the best presentation with audio and graphics. The separation architecture in this embodiment reduces the network bandwidth needed, since the outcome throughout is still distributed from the back-end server 140. Further, because the media or all the animation controlling game flow are not sent through the server 140 but are instead downloaded to the smart client, only requested game results travels over the network, thereby reducing the traffic on the network.

An embodiment of this smart client is adapted to download multiple different game presentation images and engines to its second processor 120. If only a number of the downloaded presentation engines may be presented for play at any one time, capability in the smart client may be provided to store the most popular game titles/engines.

In one embodiment, each presentation engine on the EGM is associated with a virtual EGM. At least one virtual EGM exists and has an accounting "bucket" for each of the presentation game engines present on a physical EGM, and virtual EGMs allow easier and effective game allocation among different EGMs. Where a player chooses to play an enabled game on an EGM, the accounting of that game is accounted for in its virtual EGM accounting bucket. In one embodiment, in order for a game to be played, its physical EGM has the game tied to a virtual EGM in the back-end server 140 at the time the game was installed on the EGM. Games may be added easily to an EGM at any time in one embodiment, but a game deletion can be configured to be more difficult. For example, games can be just disabled so that they are not available for play, with a game deletion configures to be a more lengthy process. To document the games played on an EGM over the lifetime of the EGM, an accounting system can be provided to document the game history for that EGM.

Figure 5:
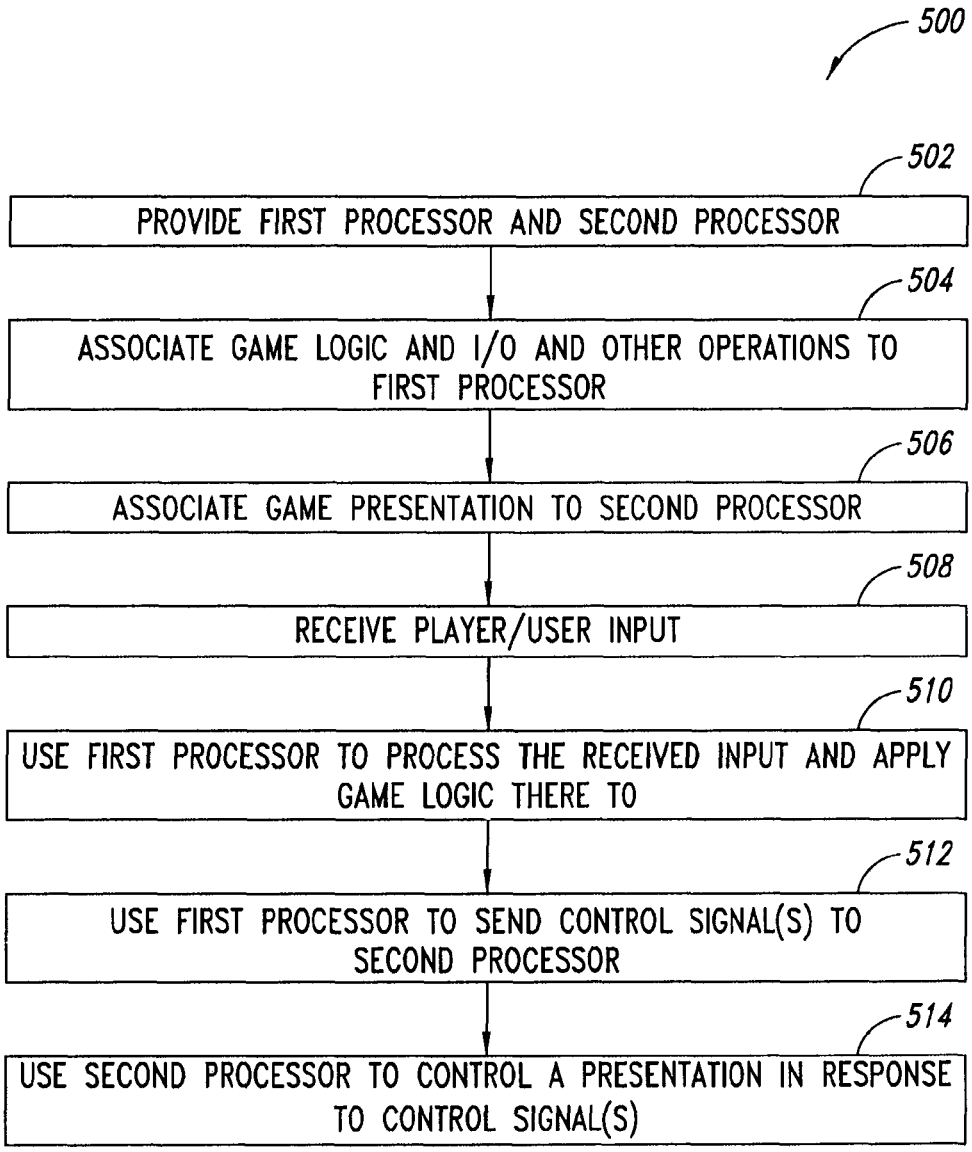
FIG. 5 is a flowchart of one embodiment of a method of operating a multi-processor architecture.

FIG. 5 is a flowchart of a method 500 to operate a multi-processor architecture, according to one embodiment. In one embodiment, at least some operations depicted in the method 500 can be implemented via software or other processor-executable instructions stored on a processor-readable storage medium (such as the hard disk 122, the flash 102, and/or any other processor-readable storage medium present at the EGM or at the back-end server 140 or the devices 150/152) and executable by the first processor 100 and/or by the second processor 120 and/or by a processor of the back-end server 140 and/or by the processors of the devices 150/152. Moreover, the various operations depicted in the method 500 need not necessarily occur in the exact order shown. Various operations can be added, removed, modified, or combined in certain embodiments.

At a block 502, a plurality of processors for the multi-processor architecture is provided. In one embodiment such as described above, the first processor 100 and the second processor 120 are provided. Both of the processors may be provided in an EGM; or in the case of server-based gaming the second processor 120 may be provided in the EGM or other client device, while the first processor 100 can be located at the server 140. In other SBG implementations, the first processor 100 can be located at the EGM or other client device, along with the second processor 120.

At a block 504, the game logic, I/O, and other operations are associated with the first processor 100 for its execution. As previously described above, such association can include having the first processor 100 designated to execute the game logic engine such that gaming operations and processing of player input will be controlled/managed by the first processor 100.

At a block 506, the game presentation (including presentation of multimedia content) is associated with the second processor 129 for execution. As previously described above, such association can include having the second processor 120 designated to execute the presentation engine such that presentation of game play output will be controlled/managed by the second processor 120.

According to the various embodiments previously described above, the presentation engine may be downloaded to the second processor 120 from the server 140, at the block 506, if the second processor needs to have the presentation engine installed therein in order to present content of a particular game. The logic engine can be located at the EGM or other client device, or at the server 140, depending on the particular implementation of server-based gaming or non-server-based gaming that is used.

At the blocks 504-506, allocation of tasks pertaining to presentation that are to be performed by the second processor 120, versus tasks pertaining to I/O and game logic that are to be performed by the first processor 100, can be configured programmatically in one embodiment, for example by having a system administrator configure or otherwise program the EGM (and/or server 140 and/or the devices 150 and 142) to designate which tasks are to be performed by the first processor 100 and by the second processor 120. This task allocation can be performed at a higher level, for example by having the system administrator designate which application programs (e.g., the game logic engine, a communications application program, etc.) are to be run entirely by the first processor 100, and which other application programs (e.g., the presentation engine, a video driver program, etc.) are to be run entirely by the second processor 120. In a more granular level of task allocations, certain tasks (which may comprise only a portion of the total functionality or total number of tasks of a particular application program) can be allocated to the first processor 100, while other tasks of the same application program can be allocated to the second processor 120. In a still further granular level of task allocation, even individual instructions or instruction sets can be allocated between the two processors.

At a block 508, user input is received, such as via the buttons 116 or other user input device of the EGM. Such user input may include, for example, a request from the player to play a game, user input during the course of game play, or other types of user input.

At a block 510, the first processor 100 is used to process the received user input and to apply the game logic to the user input, for example by executing the game logic engine to provide a game result based on the user input. At a block 512, the first processor 100 sends one or more control signals to the second processor 120, via one or more communication lines between the first processor 100 and the second processor 120. Such control signal(s) may, for example, instruct the second processor 120 to display the game result. At the block 512, the first processor 100 may alternatively or additionally directly send control signals to the main display 132 to cause content to be displayed thereon, such as the content shown and described with respect to FIGS. 2-3 above.

At a block 514, the second processor 120 is used to provide/control a presentation on the main display 132 in response to the control signal(s) provided by the first processor 100. The second processor 120 of one embodiment executes the presentation engine in order to provide the game result for presentation on the main display 132.

The foregoing detailed description has set forth various embodiments of the devices and/or processes via the use of block diagrams, schematics, and examples. Insofar as such block diagrams, schematics, and examples contain one or more functions and/or operations, each function and/or operation within such block diagrams, flowcharts, or examples can be implemented, individually and/or collectively, by a wide range of hardware, software, firmware, or virtually any combination thereof. In one embodiment, the present subject matter may be implemented via Application Specific Integrated Circuits (ASICs). However, the embodiments disclosed herein, in whole or in part, can be equivalently implemented in integrated circuits, as one or more programs executed by one or more processor cores, as one or more programs executed by one or more controllers (e.g., microcontrollers), as firmware, or as virtually any combination thereof.

When logic is implemented as software and stored in memory, logic or information can be stored on any processor-readable medium for use by or in connection with any processor-related system or method. In the context of this disclosure, a memory is a processor-readable medium that is an electronic, magnetic, optical, or other physical device or means that contains or stores a computer and/or processor program. Logic and/or the information can be embodied in any processor-readable medium for use by or in connection with an instruction execution system, apparatus, or device, such as a computer-based system, processor-containing system, or other system that can fetch the instructions from the instruction execution system, apparatus, or device and execute the instructions associated with logic and/or information.

In the context of this specification, a "processor-readable medium" can be any element that can store the program associated with logic and/or information for use by or in connection with the instruction execution system, apparatus, and/or device. The processor-readable medium can be, for example, but is not limited to, an electronic, magnetic, optical, electromagnetic, infrared, or semiconductor system, apparatus or device. More specific examples (a non-exhaustive list) of the computer readable medium would include the following: a portable computer diskette (magnetic, compact flash card, secure digital, or the like), a random access memory (RAM), a read-only memory (ROM), an erasable programmable read-only memory (EPROM, EEPROM, or Flash memory), and a portable compact disc read-only memory (CDROM). Note that the processor-readable medium could even be paper or another suitable medium upon which the program associated with logic and/or information is printed, as the program can be electronically captured, via for instance optical scanning of the paper or other medium, then compiled, interpreted or otherwise processed in a suitable manner if necessary, and then stored in memory.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet, are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A computer-implemented method comprising, for each of one or more games:

executing, by one or more first processors, a logic engine for the game;

executing, by one or more second processors, a presentation engine for the game, the one or more second processors different from the one or more first processors and which execute only the presentation engine for the game;

sending, by the one or more first processors and to the one or more second processors, an indication of an outcome for the game, the indicated outcome being based at least in part on player input received by the one or more first processors;

displaying first information in a first portion of a display, the first information being received from the one or more first processors; and concurrently with the displaying of the first information, displaying second information in a distinct second portion of the display, the second information received from the one or more second processors.

2. The computer-implemented method of claim 1 wherein, for at least one of the one or more games, the second information includes the indicated outcome.

3. The computer-implemented method of claim 1 further comprising, for at least one of the one or more games and before the executing of the logic engine by the one or more first processors, downloading the logic engine to a device in which the one or more first processors are located.

4. The computer-implemented method of claim 1 further comprising, for at least one of the one or more games and before the executing of the presentation engine by the one or more second processors, downloading the presentation engine to a device in which the one or more second processors are located.

5. The computer-implemented method of claim 4 wherein the downloading of the presentation engine includes downloading one or more graphical libraries to be used by the presentation engine.

6. The computer-implemented method of claim 4 wherein the downloading of the presentation engine includes downloading the presentation engine to a device in which the one or more second processors are located.

7. The computer-implemented method of claim 6 wherein the downloading of the presentation engine includes downloading the presentation engine from a remote server.

8. The computer-implemented method of claim 7 wherein the one or more first processors that execute the logic engine are located in the remote server.

9. The computer-implemented method of claim 1 wherein the one or more first processors and the one or more second processors are located in a single device.

10. An electronic gaming system, comprising:

a first processor configured to, for each of one or more games, execute a logic engine for the game;

a second processor communicatively coupled to the first processor and which, for each of the one or more games, executes only a presentation engine for the game, the executing of the presentation engine including receiving from the first processor an indication of one or more outcomes related to the game; and a display communicatively coupled to the first and second processors to concurrently display a first type of information in a first portion of the display and a second type of information in a distinct second portion of the display, wherein the first type of information is received from the first processor and wherein the second type of information is received from the second processor.

11. The electronic gaming system of claim 10 further comprising a storage medium communicatively coupled to the first processor, the storage medium storing a set of executable instructions that corresponds to the logic engine for at least one of the one or more games.

12. The electronic gaming system of claim 10 further comprising a storage medium communicatively coupled to the second processor, the storage medium storing a set of executable instructions that corresponds to the presentation engine for at least one of the one or more games.

13. The electronic gaming system of claim 10 wherein the executing of the logic engine includes processing one or more player inputs to obtain the one or more outcomes.

14. The electronic gaming system of claim 10 wherein the display is independently controllable by each of the first and the second processors.

15. The electronic gaming system of claim 10 wherein the second type of information includes at least one of the indicated one or more outcomes.

16. The electronic gaming system of claim 10 wherein the second processor is located in a client device that, for at least one of the one or more games and before the executing of the presentation engine by the second processor, downloads the presentation engine from a remote server.

17. The electronic gaming system of claim 16 wherein, as at least part of downloading the presentation engine from the remote server, the second processor downloads one or more graphical libraries to be used by the presentation engine.

18. The electronic gaming system of claim 10 wherein the first processor is located in a remote server, and wherein the second processor is located in a client device.

19. The electronic gaming system of claim 10 wherein the first and the second processors are located in a single device.

20. The electronic gaming system of claim 19 wherein the display is located in the single device.

21. A non-transitory computer-readable medium having contents that, when executed, cause a computing device to perform a method, the method comprising:

executing, by one or more processors of the device, a presentation engine for a game, wherein the executing of the presentation engine includes receiving an indication of an outcome for the game from one or more distinct other processors, and wherein the one or more processors execute only the presentation engine; and initiating, by the one or more processors, the presentation of first information in a first portion of a display, the display concurrently presenting second information from the one or more distinct other processors in a distinct second portion of the display.

22. The non-transitory computer-readable medium of claim 21 wherein the first information includes the indicated game outcome.

23. The non-transitory computer-readable medium of claim 21 wherein the method further comprises, before the executing of the presentation engine, downloading the presentation engine from a remote server.

24. The non-transitory computer-readable medium of claim 23 wherein the presentation engine is one of a plurality of presentation engines available from the remote server, each of the plurality of presentation engines corresponding to one of a plurality of games.

25. The non-transitory computer-readable medium of claim 21 wherein the one or more distinct other processors are located in the computing device.

* * * * *